US006380825B1

(12) United States Patent
Takenoshita et al.

(10) Patent No.: US 6,380,825 B1
(45) Date of Patent: Apr. 30, 2002

(54) BRANCH TEE DIELECTRIC WAVEGUIDE LINE

(75) Inventors: Takeshi Takenoshita; Hiroshi Uchimura, both of Soraku-gun (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/497,792

(22) Filed: Feb. 3, 2000

Related U.S. Application Data

(62) Division of application No. 09/137,195, filed on Aug. 20, 1998, now Pat. No. 6,057,747.

(30) Foreign Application Priority Data

| | | |
|---|---|---|
| Aug. 22, 1997 | (JP) | 9-226174 |
| Sep. 30, 1997 | (JP) | 9-265209 |
| Dec. 24, 1997 | (JP) | 9-355284 |
| Mar. 24, 1998 | (JP) | 10-76283 |

(51) Int. Cl.[7] ..... H01P 5/12
(52) U.S. Cl. ..... 333/137; 333/125; 333/239
(58) Field of Search ..... 333/125, 137, 333/238, 239

(56) References Cited

U.S. PATENT DOCUMENTS

| | | | | |
|---|---|---|---|---|
| 2,628,311 A | 2/1953 | Lindenblad | 333/137 | |
| 2,673,962 A | 3/1954 | Kock | 333/251 X | |
| 3,072,870 A | 1/1963 | Walker | 333/249 | |
| 3,135,935 A | 6/1964 | Engelbrecht | 333/236 | |
| 3,771,077 A | 11/1973 | Tischer | 333/137 | |
| 3,958,193 A | 5/1976 | Rootsey | 333/214 | |
| 4,272,744 A | 6/1981 | Schuegraf | 333/249 | |
| 5,532,661 A | 7/1996 | Lagerlof | 333/125 | |

FOREIGN PATENT DOCUMENTS

| | | | | |
|---|---|---|---|---|
| EP | 0677885 A1 | 10/1995 | | |
| JP | 3-167903 | * 7/1991 | | 333/125 |
| JP | 05160612 | 6/1993 | | |
| JP | 6053711 | 2/1994 | | |
| JP | 08139505 | 5/1996 | | |
| SU | 1370689 | 1/1988 | | |
| SU | 1406674 | 6/1988 | | |

OTHER PUBLICATIONS

Joubert et al., "Design of Unequal H–Plane Waveguide Power Dividers for Array Applications," Feb. 1997, Microwave Journal, pp. 24–34.*

Obata et al., "E–Plane Symmetrical Tee Having a Triangular Reflector", IEICE Transactions, vol. E74, Oct. 1991. No. 10, Tokyo, Japan, pp. 3352–3356.

* cited by examiner

*Primary Examiner*—Justin P. Bettendorf
(74) *Attorney, Agent, or Firm*—Hogan & Hartson, L.L.P.

(57) ABSTRACT

A high-frequency dielectric waveguide line comprising a dielectric substrate with two conductor layers on its two surfaces, and a plurality of rows of through conductors in the substrate connecting the two conductor layers. The distances between the through conductors in each row are no more than half of the wavelength of the signal transmitted in the transmission direction of the waveguide. The waveguide line has a branching portion where a first waveguide line having a width d branches into second and third parallel waveguide lines both of width d. The portion of the waveguide at the branching point has a width of A, where $2d \leqq A \leqq 3d$. The first, second and third waveguide lines are connected without abrupt width enlargement. The branching waveguide line have small transmission losses for high-frequency signals.

8 Claims, 21 Drawing Sheets

FREQUENCY CHARACTERISTICS

FREQUENCY CHARACTERISTICS

BRANCH TEE DIELECTRIC WAVEGUIDE LINE

This is a division of application Ser. No. 09/137,195 filed Aug. 20, 1998, now U.S. Pat. No. 6,057,747 which application is hereby incorporated by reference in its entirety.

BACKGROUND OF THE INVENTION

1. Field of the Invention

The present invention relates to a dielectric waveguide line for transmitting a high-frequency signal of the microwave band or the millimeter band, and particularly to a dielectric waveguide line having a bent or branched portion.

2. Description of the Related Art

In a high-frequency circuit which handles a high-frequency signal of the microwave band or the millimeter band, a transmission line for transmitting the high-frequency signal is requested to have a reduced size and a small transmission loss. If such a transmission line can be formed on or in a substrate which constitutes a circuit, it is advantageous to miniaturization. In the prior art, therefore, a strip line, a microstrip line, a coplanar line, or a dielectric waveguide line is used as such a transmission line.

Among these lines, a strip line, a microstrip line, and a coplanar line have a structure which consists of a dielectric substrate, a signal line composed of a conductor layer, and a ground conductor layer, and in which an electromagnetic wave of a high-frequency signal propagates through the space and the dielectric around the signal line and the ground conductor layer. These lines, have no problem in transmitting signals within a band of not more than 30 GHz. For transmission of signals of 30 GHz or more, however, a transmission loss is easily produced.

By contrast, a waveguide line is advantageous because the transmission loss is small also in the millimeter band of not less than 30 GHz. In order to utilize excellent transmission characteristics of such a waveguide, also a line which can be formed in a multilayer substrate has been proposed.

In Japanese Unexamined Patent Publication JP-A 6-53711 (1994), for example, a waveguide line is proposed in which a dielectric substrate is sandwiched between a pair of conductor layers and side walls are formed by two rows of via holes through which the conduct layers are connected to each other. In the waveguide line, the four sides of a dielectric material are surrounded by pseudo conductor walls configured by the conductor layers and the via holes. whereby the region in the conductor walls is formed as a line for signal transmission. The waveguide line has a very simple structure and an apparatus can be miniaturized as a whole.

When a high-frequency circuit is to be configured, usually, formation of a bent or branched portion in a wiring circuit of a transmission line is inevitable. Particularly, in the case where a feeder line for array antennas or the like is to be formed, a branch must be formed in a wiring circuit of a transmission line.

However, a strip line, a microstrip line, and a coplanar line have a problem in that, because a signal line is not completely covered with a ground conductor layer formation of a branch at a midpoint of a transmission line causes an electromagnetic wave to be radiated from the branch, thereby increasing the transmission loss.

As a dielectric waveguide line, furthermore, known is an NRD guide having a structure in which a dielectric line is sandwiched between two ground conductor plates and the portion between the ground conductor plates and other than the dielectric waveguide line is filled with the air. In order to form a branch in the structure, a method in which two bent lines are coupled together to form a directional coupler is employed. When a bent portion exists in a line, however there arises another problem in that different propagation modes are produced depending on the shape and the transmission loss is increased and hence strict restriction is imposed on the design. A dielectric waveguide line is usually made of fluororesin or the like. Particularly, a line which is to be used in a high frequency region has a reduced size and hence it is difficult to work a bent portion and the like, thereby causing a further problem in that it is difficult to obtain such a line by mass production. Moreover, there Is a further problem in that it is difficult to form such a line as a wiring of a high frequency circuit on or in a dielectric substrate.

A conventional waveguide has a structure in which an electromagnetic wave propagates through a space surrounded by metal walls, and hence does not produce a loss due to a dielectric. Therefore, the loss at a high frequency is small, and, even where there is a branch, a radiation loss is not produced. However, such a waveguide has a problem in that the size of the waveguide is larger than that of a transmission line using a dielectric. By contrast, a dielectric waveguide line which is filled with a dielectric of a specific dielectric constant of $\in_r$ can be produced at a size which is $1/\sqrt{\in_r}$ of that of a conventional one. However, such a waveguide also has a problem in that it is difficult to form such a waveguide on or in a dielectric substrate.

In a dielectric waveguide line such as that proposed in Japanese Unexamined Patent Publication JP-A 6-53711 (1994), when a bent or branched portion is simply formed in a line for signal transmission which is surrounded by pseudo conductor walls configured by the pair of conductor layers and the two rows of via holes, the electromagnetic field is disturbed, thereby producing a problem in that the transmission loss is increased.

In order to produce a wiring circuit of a transmission line in which a branch for forming a feeder line for an array antenna or the like in a dielectric substrate, therefore, it has been requested to develop a branch structure of a dielectric waveguide line which can be formed in a dielectric substrate, which does not radiate an electromagnetic wave, and in which the transmission loss is small.

SUMMARY OF THE INVENTION

The invention has been conducted in view of the above-discussed circumstances. It is an object of the invention to provide bent and branched portions of a dielectric waveguide line which can be formed in a dielectric substrate, in which a high-frequency signal does not radiate or leak an electromagnetic wave, and which has excellent transmission characteristics of a small transmission loss.

The Inventors have intensively studied the above-discussed problems. As a result, the inventors have found that, when, in a dielectric waveguide line and in a bent portion disposed in a transmission line having a structure which is formed by complete covering of a pair of conductor layers that are electrically connected to two rows of through conductor groups disposed in a dielectric substrate, the two rows of through conductor groups have a predetermined arrangement structure, radiation and leakage of an electromagnetic wave of a high-frequency signal hardly occur and excellent transmission characteristics of a low transmission loss can be realized even when such a bent portion exists in the transmission line.

Moreover, it has been found that, when, in a dielectric waveguide line, a transmission line comprising a dielectric waveguide line having a structure formed by completely covering upper and lower portions of two rows of through conductor groups with a pair of conductor layers which are electrically connected to the two rows of through conductor groups is disposed in a dielectric substrate, and through conductors of the two rows of through conductor groups have a predetermined arrangement structure in a branch in which the transmission line is connected in a T-like shape and transmission directions of a high-frequency signal are perpendicular to each other, a branch structure of a transmission line in which radiation and leakage of an electromagnetic wave of a high-frequency signal hardly occur and which has excellent transmission characteristics of a low transmission loss can be realized. Moreover, it has been found that, in a branch where second and third transmission lines which are disposed in parallel with a first dielectric waveguide line are connected together so that transmission directions of a high-frequency signal are parallel to each other, through conductors of through conductor groups have a predetermined arrangement structure, a branch structure of a transmission line in which radiation and leakage of an electromagnetic wave of a high-frequency signal hardly occur and the power ratio after branch can be arbitrarily set, and which has excellent transmission characteristics of a low transmission loss can be realized. Furthermore, it has been found that, in a branch where fourth to sixth transmission lines which are disposed in parallel with second and third transmission lines are connected together so that transmission directions of a high-frequency signal are parallel to each other, through conductors of two rows of through conductor groups have a predetermined arrangement structure, a branch structure of a transmission line in which radiation and leakage of an electromagnetic wave of a high-frequency signal hardly occur and the power ratio after branch can be arbitrarily set, and which has excellent transmission characteristics of a low transmission loss can be realized.

In a first aspect of the invention, there is provided a dielectric waveguide line having a bent portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, the high-frequency signal being transmitted through a region surrounded by the conductor layers and the through conductor groups, wherein the two rows of through conductor groups are arranged to form bent portions, the bent portion of one of the two rows being formed into an edgy shape a bending point of which is one of the through conductors, the bent portion of the other of the two rows being formed into an arcuate shape a center of which is the one through conductor, having a radius equal to the constant width (d).

In a second aspect of the invention, there is provided a dielectric waveguide line having a bent portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, the high-frequency signal being transmitted through a region surrounded by the conductor layers and the through conductor groups, wherein the two rows of through conductor groups are arranged to form bent portions, the bent portion of one of the two rows being formed into an edgy shape a bending point of which is one of the through conductors, the bent portion of the other of the two rows being formed into an edgy shape corresponding to a base of an Isosceles triangle a vertex of which is the bent point of the one row, having a height equal to the constant width (d).

In a third aspect of the invention, there is provided a dielectric waveguide line having a bent portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, the high-frequency signal being transmitted through a region surrounded by the conductor layers and the through conductor groups, wherein the two rows of through conductor groups are arranged to form bent portions, the bent portions being arranged in a concentric arcuate shape.

The dielectric waveguide line according to the invention comprises: the pair of conductor layers between which the dielectric substrate is sandwiched; and the two rows of through conductor groups which are formed to electrically connect the conductor layers to each other at repetition intervals not more than one half of the signal wavelength of the high-frequency signal in the transmission direction of the high-frequency signal, and at the constant width (d) in a direction perpendicular to the transmission direction. Therefore, the conductor layers and the through conductor groups form portions corresponding to pseudo conductor walls of a dielectric waveguide which are parallel to the E and H planes or the H and E planes, respectively. Consequently, a transmission line for a high-frequency signal and having characteristics similar to those of a dielectric waveguide can be obtained by a flat plate structure using a dielectric substrate.

In the dielectric waveguide line of the invention, since the two rows of through conductor groups are arranged in the above-mentioned specific structure, radiation of electromagnetic wave hardly occurs and excellent transmission characteristics of low transmission loss can be realized.

In a fourth aspect of the invention, there is provided a branch structure of a dielectric waveguide line having a T-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line so that transmission directions of the lines are perpendicular to each other, wherein a width (w) of the opening satisfies relationships of $d<w\leqq 5d$ with respect to the constant width (d), and the tip end of the first dielectric waveguide line is connected to the opening by connection through conductor groups linearly arranged.

In a fifth aspect of the invention there is provided a branch structure of a dielectric waveguide line having a T-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line so that transmission directions of the lines are perpendicular to each other, wherein a width (w) or the opening satisfies relationships of $d<w\leqq 5d$ with respect to the constant width (d), and the tip end of the first dielectric waveguide line is connected to the opening by connection through conductor groups arcuately arranged.

In a sixth aspect of the invention, there is provided a branch structure of a dielectric waveguide line having a T-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line so that transmission directions of the lines are perpendicular to each other, wherein a width (w) of the opening satisfies relationships of $d<w\leqq 5d$ with respect to the constant width (d), and the tip end of the first dielectric waveguide line is connected to the opening by intermediate through conductor groups which have a width equal to the width of the opening and a length that is about one quarter of a guide wavelength of the high-frequency signal.

In a seventh aspect of the invention, there is provided a branch structure of a dielectric waveguide line having a T-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first and second dielectric waveguide lines which transmit the high-frequency signal through a region surrounded by the conductor layers and the through conductor groups being disposed, a tip end of the first dielectric waveguide line being perpendicularly connected to an opening disposed in one side of the second dielectric waveguide line, wherein the through conductor groups in another side opposed to the opening of the second dielectric waveguide line are formed along two arcs which are respectively centered at through conductors at ends of the opening and which have a radius equal to the constant width (d), to have a vertex at an intersection of the two arcs.

In an eighth aspect of the invention, there is provided a branch structure of a dielectric waveguide line having a T-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first and second dielectric waveguide lines which transmit the high-frequency signal through a region surrounded by the conductor layers and the through conductor groups being disposed, a tip end of the first dielectric waveguide line being perpendicularly connected to an opening disposed in one side of the second dielectric waveguide line, wherein the through conductor groups in another side opposed to the opening of the second dielectric waveguide line are formed along oblique sides of a triangle which has a base equal to the width of the opening, a vertex on a center line of the first dielectric waveguide line, and a height of d/2 or less.

In a ninth aspect of the invention, in the branch structure of a dielectric waveguide line having a T-branched portion of any one of the fourth through sixth aspects, the through conductor groups in another side opposed to the opening of the second dielectric waveguide line are formed along two arcs which are respectively centered at through conductors at ends of the opening and which have a radius equal to the constant width (d), to have a vertex at an intersection of the two arcs.

In a tenth aspect of the invention, in the branch structure of a dielectric waveguide line having a T-branched portion of any one of the fourth through sixth aspects, the through conductor groups in another side opposed to the opening the second dielectric waveguide line are formed along oblique sides of a triangle which has a base equal to the width of the opening, a vertex on a center line of the first dielectric waveguide line and a height of d/2 or less.

In an eleventh aspect of the invention, there is a branch structure of a dielectric waveguide line having a T-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line with setting transmission directions of the lines to be perpendicular to each other, wherein a width (w) of the opening satisfies relationships of $d<w\leqq 2d$ with respect to the constant width (d), the tip end of the first dielectric waveguide line is connected to the opening by connection through conductor groups in which through conductors are arranged along arcs, and the through conductor groups in another side opposed to the opening of the second dielectric waveguide line is formed along two arcs which are respectively concentric with the arcs and which have a radius equal to a sum (r+d) of a radius (r) of the arcs and the constant width (d), to have a vertex at an intersection of the two arcs.

According to the branch structure of a dielectric waveguide line having a T-branched portion of the invention, the pair of conductor layers and the two rows of through conductor groups constituting the dielectric waveguide line disposed in the dielectric substrate form portions corresponding to pseudo conductor walls of a dielectric waveguide which are parallel to the E and H planes or the H and E planes, respectively, and a transmission line for a high-frequency signal and having characteristics similar to those of a dielectric waveguide can be obtained by a flat plate structure using a dielectric substrate. In such wiring of transmission lines, when a branch having a structure in which two transmission lines are connected to each other perpendicularly or in a T-like shape is to be formed, the two rows of through conductor groups are arranged in the above-mentioned specific structure, thereby obtaining a structure in which radiation of an electromagnetic wave hardly occurs in the branch and excellent transmission characteristics of a low transmission loss can be realized.

In a twelfth aspect of the invention, there is provided a branch structure of a dielectric waveguide line having a parallel-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first to third dielectric waveguide lines which transmit the high-frequency signal through a region surrounded by the conductor layers and the through conductor groups are disposed while the second and third dielectric waveguide lines share one of the rows of through conductor groups, and a tip end of the first dielectric waveguide line is connected to ends of tip ends of the second and third dielectric waveguide lines by connection through conductor groups while the tip ends of the second and third dielectric waveguide lines are opposed to the tip end of the first dielectric waveguide line so that transmission directions of the high-frequency signal in the dielectric waveguide lines are parallel to each other.

According to the configuration of the invention, while the width (d) of the first dielectric waveguide line in front of the branch is widened through the connection through conductor groups, the first dielectric waveguide line is connected to the second and third dielectric waveguide lines so that transmission directions of a high-frequency signal are parallel to each other, and the high-frequency signal is branched from the first dielectric waveguide line into the second and third dielectric waveguide lines, thereby changing the width (d) of the dielectric waveguide line to the width (2d) of a connection dielectric waveguide line. Therefore, mismatching of the characteristic impedance in the branched portion can be made smaller than that in the case of a T-branch in which the width is usually changed to the width a ($2d<<a<\infty$) of a connection dielectric waveguide line. The reflection of a high-frequency signal in the branched portion can be reduced, and the transmission loss can be reduced.

In a thirteenth aspect of the invention, there is provided a branch structure of a dielectric waveguide line having a parallel-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first to third dielectric waveguide lines which transmit the high-frequency signal through a region surrounded by the conductor layers and the through conductor groups are disposed in parallel while the second and third dielectric waveguide lines are arranged with aligning tip ends so that a distance (A) between outer through conductor groups satisfies relationships of $2d<A\leqq 3d$ with respect to the constant width (d), tip ends of adjacent rows of through conductor groups are connected to each other by auxiliary connection through conductor groups, and a tip end of the first dielectric waveguide line is connected to ends of the tip ends of the second and third dielectric waveguide lines by connection through conductor groups while the tip ends of the second and third dielectric waveguide lines are opposed to the tip end of the first dielectric waveguide line so that transmission directions of the high-frequency signal in the dielectric waveguide lines are parallel to each other.

According to the configuration of the invention, while the width (d) of the first dielectric waveguide line in front of the branch is widened to the width A ($2d<A\leqq 3d$) through the connection through conductor groups, the second and third dielectric waveguide lines are connected with forming a distance of (A−2d) therebetween and in parallel with each other, and a high-frequency signal is branched from the first dielectric waveguide line into the second and third dielectric waveguide lines, thereby changing the width of the dielectric waveguide line from the width (d) of the first dielectric waveguide line to the width (A) of a connection through conductor groups. Therefore, mismatching of the characteristic impedance in the branched portion can be made smaller than that in the case of a usual T-branch. The distance (A−2d) can be formed between the second and third dielectric waveguide lines. The freedoms in design are enhanced and the isolation property can be improved.

In a fourteenth aspect of the invention, in the branch structure of a dielectric waveguide line having a parallel-branched portion of the abovementioned twelfth or thirteenth aspects of the invention, through conductors for adjusting a power ratio after branch are formed between the two rows of through conductor groups of at least one of the second and third dielectric waveguide lines.

According to the configuration of the invention, the through conductors for adjusting a power ratio are formed in at least one of the second and third dielectric waveguide lines, for example, in the third dielectric waveguide line. Consequently, the characteristic impedance of the third dielectric waveguide line is higher than the characteristic impedances of the first and second dielectric waveguide lines, and the cut-off frequency of the third dielectric waveguide line becomes higher. With respect to an electromagnetic wave which has propagated through the first dielectric waveguide line, therefore, a wave of a frequency between the cut-off frequency of the second dielectric waveguide line and that of the third dielectric waveguide line propagates through only the second dielectric waveguide line, and a wave of a frequency which is not lower than the cut-off frequency of the third dielectric waveguide line propagates through both the second and third dielectric waveguide lines. Namely, as the frequency is higher, an electromagnetic wave propagates more easily through the third dielectric waveguide line. As a result, the power ratio after branch is not 1:1 or the evenly distributed branch is not performed. Therefore, an arbitrary power ratio can be obtained by adequately selecting the position and number of the through conductors for adjusting a power ratio.

In a fifteenth aspect of the invention, in the branch structure of a dielectric waveguide line having a parallel-branched portion of the abovementioned twelfth or thirteenth aspects of the invention, a center line of the first dielectric waveguide line is shifted from a center line of the second and third dielectric waveguide lines.

According to the configuration of the invention, the center line of the first dielectric waveguide line is shifted from the center line of the second and third dielectric waveguide lines by a distance (h: $0<h<d/2$) toward, for example, the second dielectric waveguide line. In this case, propagation to the second dielectric waveguide line is made easier in accordance with the degree of the distance (h). In other words, an arbitrary power ratio can be obtained by adequately selecting the distance (h). When the distance (h) is 0, the power ratio after branch is 1:1.

Alternatively, the power ratio after branch may be selected while the configurations of the fourteenth and fifteenth aspects are combined together.

In a sixteenth aspect of the invention, there is provided a branch structure of a dielectric waveguide line having a parallel-branched portion comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width (d) in a direction perpendicular to the transmission direction, first to sixth dielectric waveguide lines which transmit the high-frequency signal through a region surrounded by the conductor layers and the through conductor groups are disposed while the second and third dielectric waveguide lines are juxtaposed with opposing ends of one side of the second and third dielectric waveguide lines to one end of the first dielectric waveguide line so that transmission directions of the high-frequency signal are parallel to each other, and the fourth to sixth dielectric waveguide lines are juxtaposed with opposing ends of one side of the fourth to sixth dielectric waveguide lines to ends of other side of the second and third dielectric waveguide lines, and placing the fourth and sixth dielectric waveguide lines on sides of the fifth dielectric waveguide line so that transmission directions of the high-frequency signal are parallel to each other, the second and third dielectric waveguide lines are disposed in parallel with aligning the tip ends of the one side and the tip ends of the other side so that a distance (A) between outer through conductor groups satisfies relationships of $2d \leqq A \leqq 3d$ with respect to the constant width (d), tip ends of the one side and tip ends of the other side of adjacent rows of through conductor groups are connected to each other by first and second auxiliary connection through conductor groups, and a tip end of the first dielectric waveguide line is connected to both ends of the tip ends of the one side of the second and third dielectric waveguide lines by first connection through conductor groups, and the fourth to sixth dielectric waveguide lines are disposed in parallel with aligning the tip ends of the one side so that a distance (B) between outer through conductor groups of the fourth and sixth dielectric waveguide lines satisfies relationships of $3d \leqq B \leqq 4d$ with respect to the constant width (d), tip ends of adjacent through conductor groups of the fourth and fifth dielectric waveguide lines are connected to each other by third auxiliary connection through conductor groups, tip ends of adjacent through conductor groups of the fifth and sixth dielectric waveguide lines are connected to each other by fourth auxiliary connection through conductor groups, and ends of the other side of the second and third dielectric waveguide lines are connected to both ends of the one side of the fourth to sixth dielectric waveguide lines by second connection through conductor groups.

According to the configuration of the invention, one dielectric waveguide line can be branched into three dielectric waveguide lines. In this case, when the configuration of the twelfth or thirteenth is repeated, the transmission loss in the branched portion can be reduced.

In a seventeenth aspect of the invention, in the branch structure of a dielectric waveguide line having a parallel-branched portion of the abovementioned sixteenth aspects of the invention, through conductors for adjusting a power ratio after branch are formed between the two rows of through conductor groups of at least one of the second and third dielectric waveguide lines, and/or between the two rows of through conductor groups of at least one of the fourth to sixth dielectric waveguide lines.

According to the configuration of the invention, the configuration of the fourteenth aspect is added to the branch structure of a dielectric waveguide line of the sixteenth aspect in which one dielectric waveguide line is branched into three dielectric waveguide lines. According to this configuration, the power ratio after branch can be arbitrarily set. When the configuration of the fifteenth aspect of the invention is further added, the adjustment width of the power ratio after branch can be further widened.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
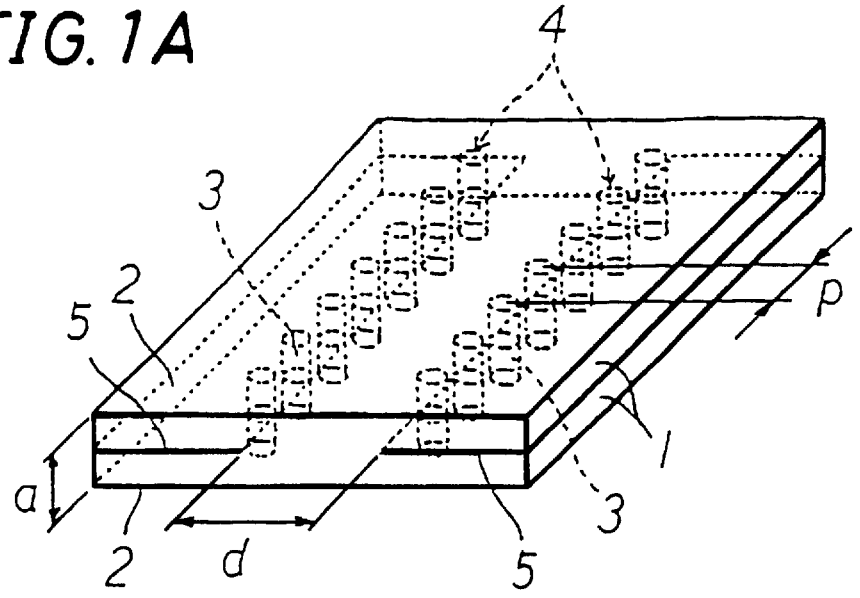
FIGS. 1A and 1B are schematic perspective views illustrating a dielectric waveguide line used in the invention.

Now referring to the drawings, preferred embodiments of the invention are described below.

Figure 1B:
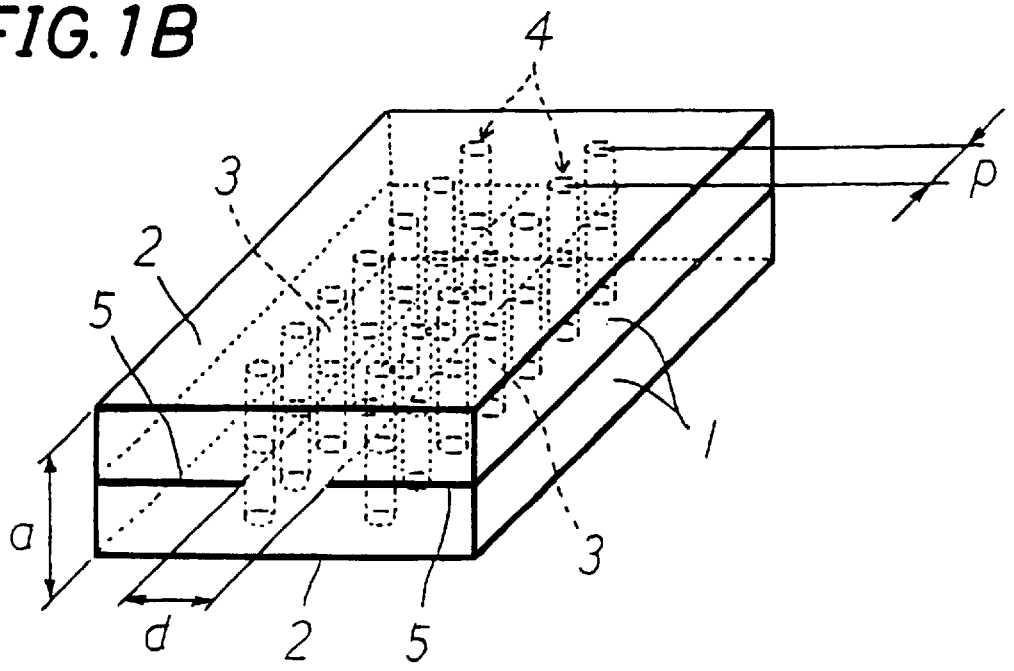

FIGS. 1A and 1B are schematic perspective views a linear portion and illustrating a configuration example of the dielectric waveguide line of the invention. In the dielectric waveguide line, a pair of conductor layers 2 are formed at positions where a flat plate-like dielectric substrate 1 having a predetermined thickness a is sandwiched. The conductor layers 2 are formed on the upper and lower faces of the dielectric substrate 1 between which at least a transmission line formation position is sandwiched, respectively. A number of through conductors 3 through which the conductor layers 2 are electrically connected to each other are disposed between the conductor layers 2. As shown in the figures, the through conductors 3 are formed into two rows at repetition intervals p which are not more than one half of the signal wavelength of a high-frequency signal which is to be transmitted by the line, in a transmission direction of the high-frequency signal, i.e., the line formation direction, and at a fixed interval (width) d in a direction perpendicular to the transmission direction, thereby forming through conductor groups 4 which serve as a transmission line.

A TEM wave can propagate between the pair of conductor layers 2 which are arranged in parallel. When the intervals p of the through conductors 3 in each of the rows of through conductor groups 4 are more than one half of the signal wavelength of, therefore, even a supply of an electromagnetic wave to the line cannot produce propagation along a pseudo conductor waveguide formed in the line. By contrast, when the intervals p of the through conductors 3 are not more than one half of the signal wavelength, electrical side walls are formed and hence an electromagnetic wave cannot propagate in a direction perpendicular to the transmission line and propagates in the direction of the transmission line while being repeatedly reflected. As a result, because of the region which is surrounded by the conductor layers 2 and the through conductor groups 4 that are structured as described above and which has a section area of a×d, it is possible to obtain excellent transmission characteristics which are very analogous to those of a dielectric waveguide.

In this case, the thickness a of the dielectric substrate 1 is not particularly restricted. When the line is used in the single mode, however, it is preferable to set the thickness to be about one half or about two times of the constant width d. In the examples of FIG. 1, portions corresponding to the H and E planes of a dielectric waveguide are formed by the conductor layers 2 and the through conductor groups 4, respectively. When the thickness a is set to be about one half of the constant width d as shown in FIG. 1A, portions corresponding to the H and E planes of a dielectric waveguide are formed by the conductor layers 2 and the through conductor groups 4, respectively. When the thickness a is set to be about two times of the constant width d as shown in FIG. 1B, portions corresponding to the E and H planes of a dielectric waveguide are formed by the conductor layers 2 and the through conductor groups 4, respectively.

In order to electrically connect to each other the through conductors 3 forming the rows of through conductor groups 4, auxiliary conductor layers 5 are suitably formed between the conductor layers 2. When such auxiliary conductor layers 5 are formed, the side walls of the line are formed into a fine lattice-like shape as seen from the inside of the waveguide line, by the through conductor groups 4 and the auxiliary conductor layers 5, and the shielding effect for an electromagnetic wave from the line can be further enhanced. In the example of FIG. 1, the through conductor groups 4 are formed into two rows. Alternatively, the through conductor groups 4 may be arranged into four or six rows so that pseudo conductor walls due to the through conductor groups 4 are formed doubly or triply, whereby leakage of an electromagnetic wave from the conductor walls can be more effectively prevented from occurring.

In such a structure of a waveguide line, when the relative dielectric constant of the dielectric substrate 1 is indicated by $\in_r$, the waveguide has a size which is $1/\sqrt{\in_r}$ of that of a conventional waveguide. As the relative dielectric constant of the material constituting the dielectric substrate 1 is larger, therefore, the size of the waveguide can be made smaller, and a high-frequency circuit can be miniaturized. Consequently, it is possible to obtain a size which can be used also as a transmission line of a multilayer wiring substrate in which wirings are formed in a high density, or that of a package for accommodating a semiconductor device.

As described above, the through conductors 3 constituting the through conductor groups 4 are arranged at the repetition intervals p which are not more than one half of the signal wavelength. In order to realize excellent transmission characteristics, it is preferable to form the repetition intervals p as constant repeated intervals. As far as the intervals are not more than one half of the signal wavelength, the intervals may be adequately varied or configured by combining several values.

The dielectric substrate 1 is not particularly restricted as far as It functions as a dielectric and has characteristics which do not disturb the transmission of a high-frequency signal. From the view point of accuracy in the formation of a transmission line and easiness of the production, preferably. the dielectric substrate 1 is made of ceramics.

Conventionally, ceramics of various relative dielectric constants are known. In order to transmit a high-frequency signal by the dielectric waveguide line of the invention, it is preferable to use a paraelectric material. This is because ferroelectric ceramics usually produces a large dielectric loss in a high-frequency region and hence the transmission loss is large. Therefore, it is appropriate to set the relative dielectric constant $\in_r$ of the dielectric substrate 1 to be about 4 to 100.

Usually, the line width of a wiring layer formed in a multilayer wiring substrate or a package for accommodating a semiconductor device is 1 mm at the maximum. When a material having a relative dielectric constant $\in_r$ of 100 is used and the line is used so that the upper portion is the H plane or the electromagnetic field distribution in which the magnetic field is spirally formed so as to be parallel with the upper face is produced, therefore, the minimum available frequency is calculated to be 15 GHz, and hence the line can be used also in the region of the microwave. By contrast, the relative dielectric constant $\in_r$ of a dielectric made of a resin which is usually used as the dielectric substrate 1 is about 2. When the line width is 1 mm, therefore, the line cannot be used unless the frequency is about 100 GHz or higher.

Such paraelectric ceramics include many ceramics having a very small dielectric loss tangent, such as alumina and silica. However, not all kinds of paraelectric ceramics can be used. In the case of a dielectric waveguide line, almost no loss is produced by a conductor, and the loss in the signal transmission is mainly caused by a dielectric. A loss $\alpha$ ($\alpha\delta$/m due to a dielectric can be expressed as follows:

$$\alpha=27.3\times\tan\delta/[\lambda/\{1-(\lambda/\lambda c)^2\}^{1/2}]$$

where tan $\delta$: dielectric loss tangent of the dielectric $\lambda$: wavelength in the dielectric $\lambda c$ : signal wavelength.

In conformance with standardized shapes of a rectangular waveguide (WRJ series), $\{1-(\lambda/\lambda c)^2\}^{1/2}$ in the above expression is about 0.75.

In order to reduce the loss to a practically available level of a transmission loss of −100 (dB/m) or less, it is necessary to select a dielectric so as to satisfy the following relationship:

$$f\times\in_r^{1/2}\times\tan\delta\leqq 0.8$$

where f is the used frequency (GHz).

As a material of the dielectric substrate 1 includes, for example, alumina ceramics, glass ceramics, and aluminum nitride ceramics. For example, an appropriate organic solvent is added to and mixed with powder of a ceramics raw material, into a slurry form. The mixture is formed into a sheet-like shape by using a well-known technique such as the doctor blade method or the calender roll method, to obtain plural ceramic green sheets. These ceramic green sheets are then subjected to an appropriate punching process and then stacked. Thereafter, firing is conducted at 1,500 to 1,700° C. in the case of alumina ceramics, at 850 to 1,000° C. in the case of glass ceramics, or at 1,600 to 1,900° C. in the case of aluminum nitride ceramics, thereby producing the substrate.

The pair of the conductor layers 2 are formed in the following manner. In the case where the dielectric substrate 1 is made of alumina ceramics, for example, an oxide such as alumina, silica, or magnesia, an organic solvent, and the like are added to and mixed with powder of a metal such as tungsten, into a paste-like form. The mixture is then printed onto the ceramic green sheets by the thick film printing technique so as to completely cover at least a transmission line. Thereafter, firing is conducted at a high temperature of about 1,600° C., thereby forming conductor layers 2 of a thickness of 10 to 15 $\mu$m or more. As the metal powder, preferably, copper, gold, or silver is used in the case of glass ceramics, and tungsten or molybdenum is used in the case of aluminum nitride ceramics. Usually, the thickness of the conductor layers 2 is set to be about 5 to 50 $\mu$m.

The through conductors 3 may be formed by, for example, via hole conductors, or through hole conductors. The through conductors may have a circular section shape which can be easily produced, or alternatively a section shape of a polygon such as a rectangle or a rhomboid may be used. For example, the through conductors 3 are formed by embedding metal paste similar to the conductor layers 2 into through holes which are formed by conducting a punching process on a ceramic green sheet, and then firing the metal paste together with the dielectric substrate 1. It is suitable to set the diameter of the through conductors 3 to be 50 to 300 $\mu$m.

Figure 2:
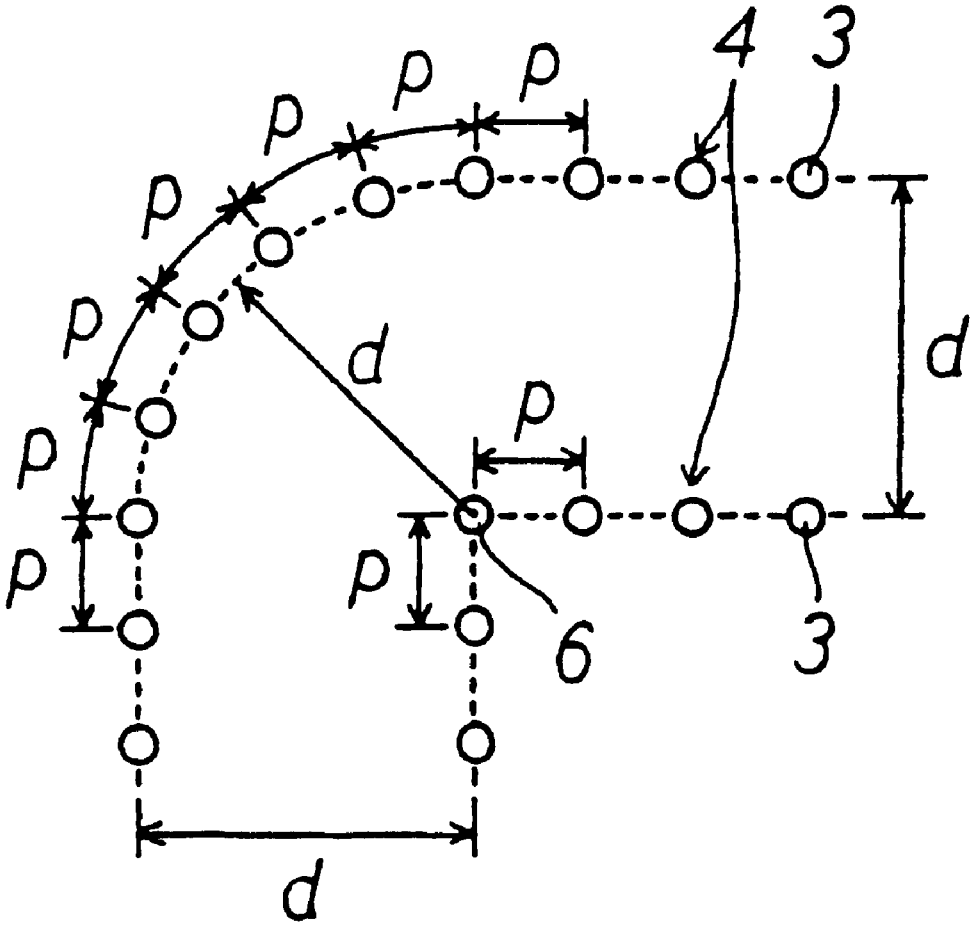
FIG. 2 is a plan view of a dielectric waveguide line having a bent portion according to a first embodiment of the invention.

In such a dielectric waveguide line, usually, a bent or branched portion is formed. A dielectric waveguide line having a bent portion according to a first embodiment of the present invention is shown in a plan view of FIG. 2. In FIG. 2 (and the figures subsequent to FIG. 2), the dielectric substrate 1 and the conductor layers 2 are not shown. The row of the through conductor group 4 which is located in the inner side of the bent portion is formed into an edgy shape a bending point of which is at one through conductor 6, and the other row which is located in the outer side is formed into an arcuate shape which is centered at the one through conductor 6.

As shown in FIG. 2, in the bent portion, the through conductor groups 4 are arranged so that the line perpendicular to the transmission direction of a high-frequency signal has the constant width d. The through conductors 3 are arranged so that the row of the through conductor groups 4 which is located in the inner side of the bent portion is formed into a bent-line-like shape in which the bending point is at the one through conductors 6. By contrast, the row of the through conductor groups 4 which is located in the outer side of the bent portion is arranged along an arc which is centered at the one through conductor 6 serving as the bending point of the row located in the inner side of the bent portion.

As described above, the through conductors 3 constituting the through conductor groups 4 are arranged at the repetition intervals p which are not more than one half of the signal wavelength. In order to realize excellent transmission characteristics, it is preferable to form the repetition intervals p as constant repeated intervals. It is a matter of course that, as far as the intervals are not more than one half of the signal wavelength, the intervals may be adequately varied or configured by combining several values. In order to sufficiently suppress radiation of an electromagnetic wave and realize excellent transmission characteristics, therefore, it is preferable to set also the repetition intervals p of the through conductors 3 constituting the row of the through conductor groups 4 which is located in the outer side of the bent portion, to have a constant value. Similarly, the intervals may be variously varied in the range not more than one half of the signal wavelength.

Figure 3:
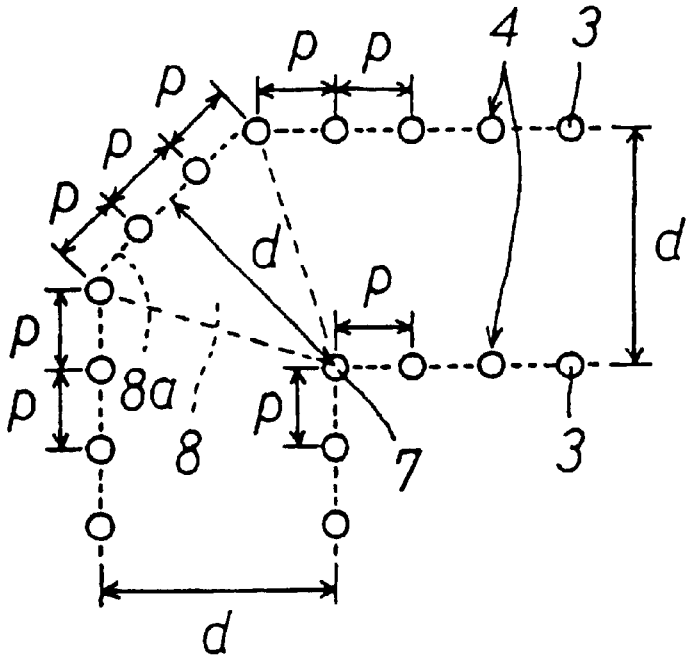
FIG. 3 is a plan view of a dielectric waveguide line having a bent portion according to a second embodiment of the invention.

A dielectric waveguide line having a bent portion according to a second embodiment of the present invention is shown in a plan view of FIG. 3. In the same manner as FIG. 2, the one row of the through conductor groups 4 which is located in the inner side of the bent portion is formed by arranging the through conductors 3 in a bent-line-like shape in which the bending point is at one through conductor 7. The other row of the through conductor groups 4 which is located in the outer side of the bent portion is formed into a bent-line-like shape corresponding to the base 8*a* of an isosceles triangle 8 in which the vertex is at the one through conductor 7 and which has a height equal to the constant width d.

The bent portion shown in FIG. 3 has a shape which is formed by obliquely cutting away an edge. As compared with the bent portion in the example shown in FIG. 2, the bent portion can be easily produced.

Figure 4:
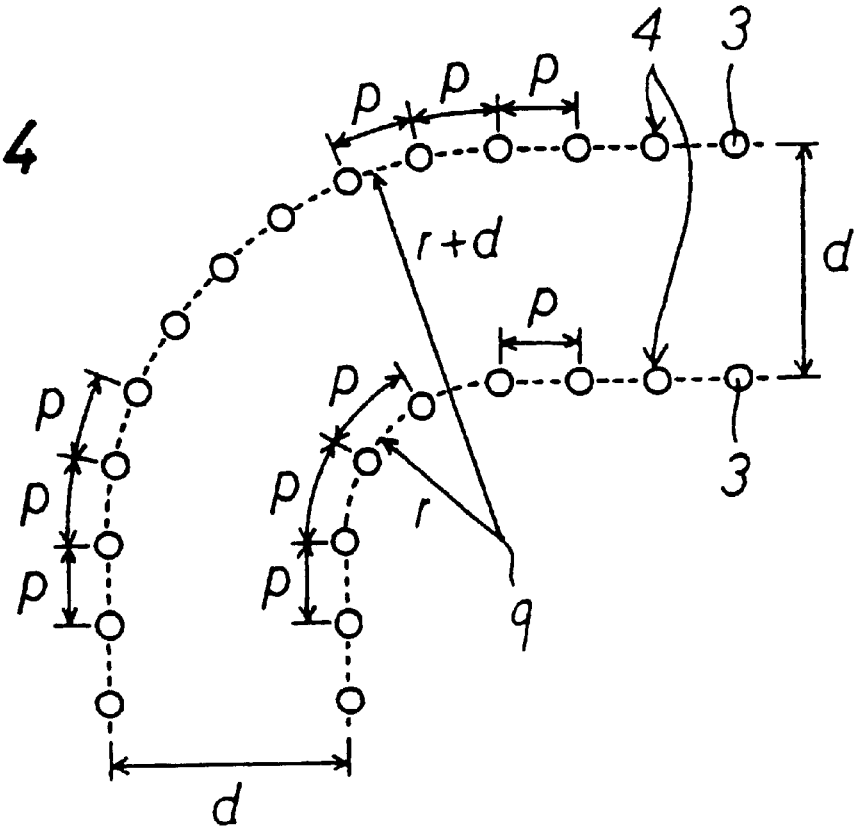
FIG. 4 is a plan view of a dielectric waveguide line having a bent portion according to a third embodiment of the invention.

A dielectric waveguide line having a bent portion according to a third embodiment of the present invention is shown in a plan view of FIG. 4. The one row of the through conductor groups 4 which is located in the inner side of the bent portion is formed by arranging the through conductors 3 in a shape of an arc which is centered at a virtual central point 9 inside the bent portion of the row and which has a predetermined radius r. The other row of the through conductor groups 4 which is located in the outer side of the bent portion is formed by arranging the through conductors 3 in a shape of an arc which is centered at the central point 9 and which has a radius (r+d) obtained by adding the constant width d to the radius r, i.e., in an arcuate shape which is concentric with the inner side row. As a result, the rows of through conductor groups 4 respectively have the bent portions which are arranged in a concentric arcuate shape.

In the example shown in FIG. 4, both the inner and outer sides of the bent portion are formed into a very smooth shape, and hence disturbance of an electromagnetic field is very low in degree. Therefore, the example has an advantage that the transmission loss is reduced.

Next, the configuration of a T-branched portion will be described. A dielectric waveguide line having a T-branched portion according to a fourth embodiment of the present invention is shown in a plan view of FIG. 5. The T-branched portion is a branch structure of a dielectric waveguide line in which a first dielectric waveguide line 16 consisting of two rows of through conductor groups 4a which are formed to electrically connect conductor layers sandwiching a dielectric substrate with a constant width d in a direction perpendicular to the transmission direction of a high-frequency signal, to each other at repetition intervals p which are not more than one half of a signal wavelength of the high-frequency signal in the transmission direction of the high-frequency signal, and a second dielectric waveguide line 17 consisting of two rows of similar through conductor groups 4*b* are disposed, and a tip end of the first dielectric waveguide line 16 is connected to an opening 18 disposed in one side of the second dielectric waveguide line 17 with setting transmission directions of the lines to be perpendicular to each other. The width w of the opening 18 satisfies the relationships of $d<w\leqq 5d$ with respect to the constant width d between the two rows the through conductor groups 4*a* and 4*b*. Through conductors 16*a* at the tip end of the first dielectric waveguide line 16 are connected to through conductors 18*a* at the edge of the opening 18 by connection through conductor groups 4*c* in which through conductors are linearly arranged.

According to this configuration, the first dielectric waveguide line 16 is connected to the second dielectric waveguide line 17 so that transmission directions of a high-frequency signal are perpendicular to each other, while the width of the transmission line of the first dielectric waveguide line 16 in front of the branch is changed by the connection through conductor groups 4*c* so as to be linearly gradually widened, and a high-frequency signal is branched by the second dielectric waveguide line 17, whereby mismatching of the characteristic impedance due to branch can be made smaller. Therefore, the reflection of a high-frequency signal in the branched portion can be reduced, with the result that the transmission loss can be reduced.

Preferably, the length l of the connection through conductor groups 4*c* in the direction of the first dielectric waveguide line 16 is $0<l<5d$. Even when the length l is made larger so as to exceed the range, the effect of reducing mismatching of the characteristic impedance to suppress the reflection of a high-frequency signal in the branched portion is small.

The repetition intervals of the through conductors 3 of the connection through conductor groups 4*c* are not more than one half of a signal wavelength of a high-frequency signal. According to this configuration, electrical side walls are formed.

Figure 6:
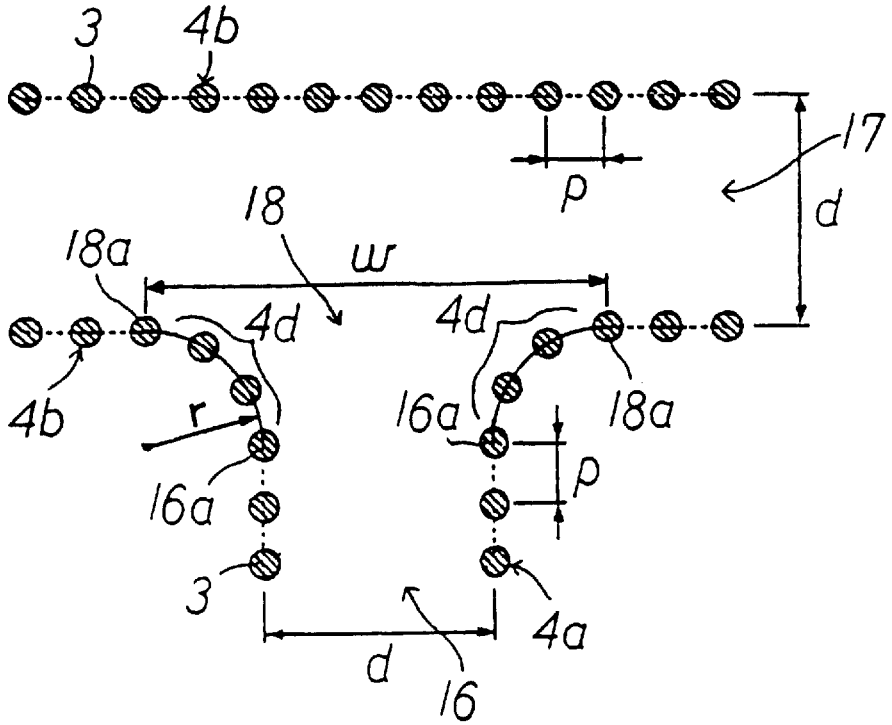
FIG. 6 is a plan view of a dielectric waveguide line having a T-branched portion according to a fifth embodiment of the invention.

A dielectric waveguide line having a T-branched portion according to a fifth embodiment of the present invention is shown in a plan view of FIG. 6. The T-branched portion is a branch structure of a dielectric waveguide line in which a first dielectric waveguide line 16 consisting of two rows of through conductor groups 4*a* which are formed to electrically connect conductor layers sandwiching a dielectric substrate with a constant width d in a direction perpendicular to the transmission direction of a high-frequency signal, to each other at repetition intervals p which are not more than one half of a signal wavelength of the high-frequency signal in the transmission direction of the high-frequency signal, and a second dielectric waveguide line 17 consisting of two rows of similar through conductor groups 4*b* are disposed, and a tip end of the first dielectric waveguide line 16 is connected to an opening 18 disposed in one side of the second dielectric waveguide line 17 with setting transmission directions of the lines to be perpendicular to each other. The width w of the opening 18 satisfies relationships of $d<w\leqq 5d$ with respect to the constant width d between the two rows of through conductor groups 4*a* and 4*b*. Through conductors 16*a* at the tip end of the first dielectric waveguide line 16 are connected to through conductors 18*a* at the edge of the opening 18 by connection through conductor groups 4*d* in which through conductors are arranged in a shape of an arc of a predetermined radius r.

According to this configuration, the first dielectric waveguide line 16 is connected to the second dielectric waveguide line 17 so that transmission directions of a high-frequency signal are perpendicular to each other, while the width of the transmission line of the first dielectric waveguide line 16 in front of the branch is changed by the connection through conductor groups 4*d* so as to be arcuately gradually widened, and a high-frequency signal is branched by the second dielectric waveguide line 17, whereby the branched portion is allowed to be smoothly connected. Therefore, mismatching of the characteristic impedance due to branch can be made smaller, and the reflection of a high-frequency signal in the branched portion can be reduced, with the result that the transmission loss can be reduced.

The through conductors of the connection through conductor groups 4*d* are arranged in a shape of an arc of the radius r. Preferably, the radius r is in the range of $0<r\leqq 2d$. When the radius r is larger than 2*d,* the propagation mode of a high-frequency signal in the branched portion is disturbed and the transmission loss tends to be increased.

The repetition intervals of the through conductors 3 of the connection through conductor groups 4*d* are not more than one half of a signal wavelength of a high-frequency signal. According to this configuration, electrical side walls are formed.

Figure 7:
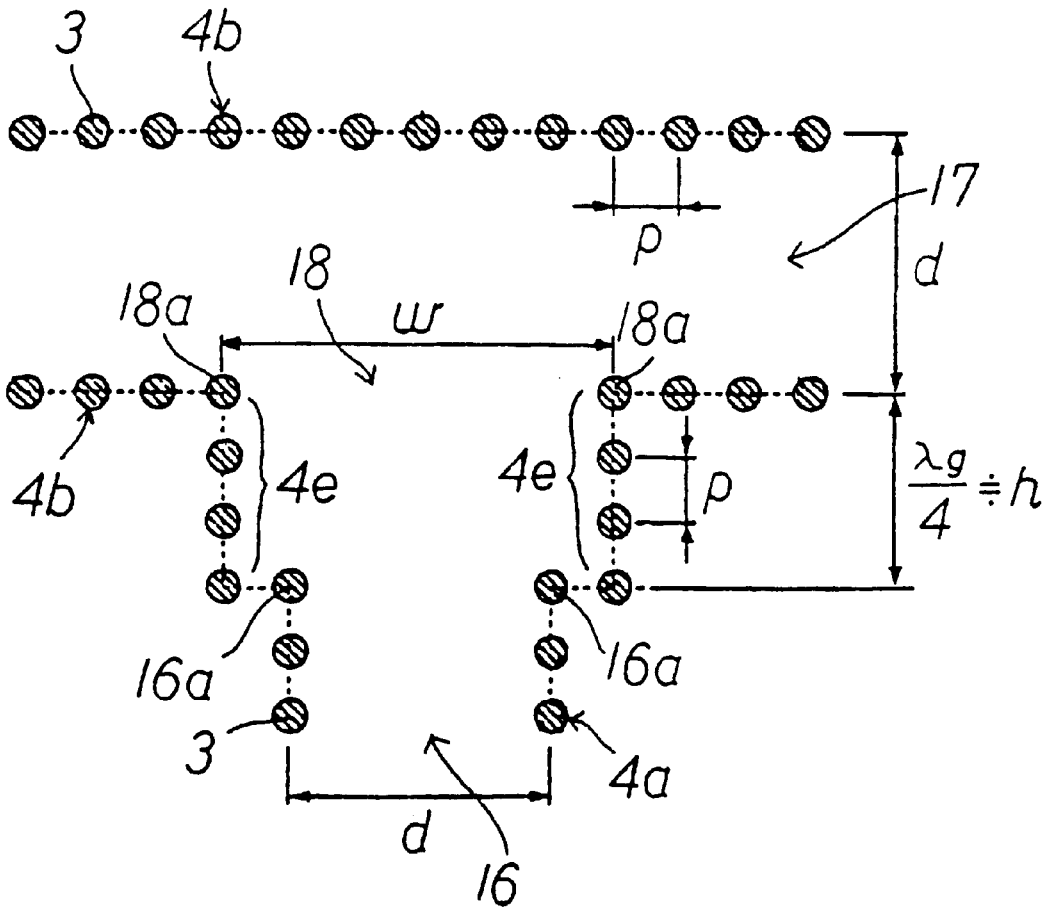
FIG. 7 is a plan view of a dielectric waveguide line having a T-branched portion according to a sixth embodiment of the invention.

A dielectric waveguide line having a T-branched portion according to a sixth embodiment of the present invention is shown in a plan view of FIG. 7. The T-branched portion is a branch structure of a dielectric waveguide line in which a first dielectric waveguide line 16 consisting of two rows of through conductor groups 4*a* which are formed to electrically connect conductor layers sandwiching a dielectric substrate with a constant width d in a direction perpendicular to the transmission direction of a high-frequency signal, to each other at repetition intervals p which are not more than one half of a signal wavelength of the high-frequency signal in the transmission direction of the high-frequency signal, and a second dielectric waveguide line 17 consisting of two rows of similar through conductor groups 4*b* are disposed, and a tip end of the first dielectric waveguide line 16 is connected to an opening 18 disposed in one side of the second dielectric waveguide line 17 with setting transmission directions of the lines to be perpendicular to each other. The width w of the opening 18 satisfies relationships of $d<w\leqq 5d$ with respect to the constant width d between the two rows of through conductor groups 4*a* and 4*b*. Through conductors 16*a* at the tip end of the first dielectric waveguide line 16 are connected to through conductors 18*a* at the edge of the opening 18 by intermediate through conductor groups 4*e* which have a width equal to the width w of the opening 18 and a length h that is about one quarter ($\lambda_g/4$) of the guide wavelength $\lambda_g$ of the high-frequency signal.

According to this configuration, the first dielectric waveguide line 16 is connected to the second dielectric waveguide line 17 so that transmission directions of a high-frequency signal are perpendicular to each other, while the width of the transmission line of the first dielectric waveguide line 16 in front of the branch is changed by the intermediate through conductor groups 4*e* so that the H plane (or the E plans) of the waveguide is widened, and a high-frequency signal is branched by the second dielectric waveguide line 17. When the characteristic impedance of the first dielectric waveguide line 16 is indicated by $Z_{m1}$ and that of the second dielectric waveguide line 17 by $Z_{m2}$, the characteristic impedances in front and in rear of the branch can be matched to each other by setting the characteristic impedance of the portion to be $\sqrt{(Z_{m1}\times Z_{m2})}$ by means of the intermediate through conductor groups 4*e,* and the length h of the intermediate through conductor groups 4*e* to be about $\lambda_g/4$. Therefore, the reflection of a high-frequency signal in the branched portion can be reduced to a very low level. As a result, a branch structure is realized in which radiation and leakage of an electromagnetic wave of a high-frequency signal do not occur and which has excellent transmission characteristics of a low transmission loss.

Figure 8:
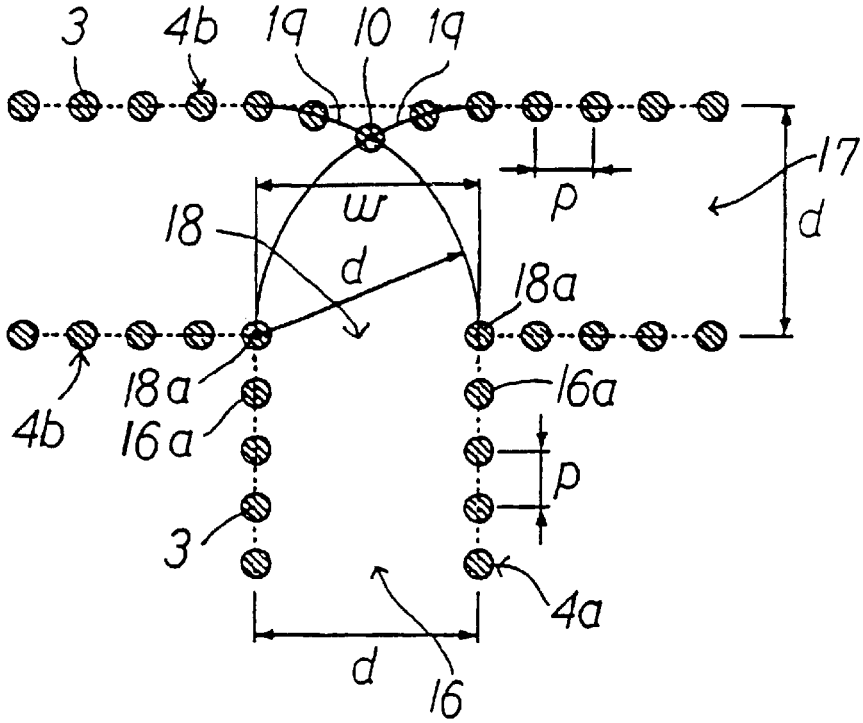
FIG. 8 is a plan view of a dielectric waveguide line having a T-branched portion according to seventh embodiment of the invention.

A dielectric waveguide line having a T-branched portion according to a seventh embodiment of the present invention is shown in a plan view of FIG. 8. The T-branched portion is a branch structure of a dielectric waveguide line in which a first dielectric waveguide line 16 consisting of two rows of through conductor groups 4*a* which are formed to electrically connect conductor layers sandwiching a dielectric substrate with a constant width d in a direction perpendicular to the transmission direction of a high-frequency signal, to each other at repetition intervals p which are not more than one half of a signal wavelength of the high-frequency signal in the transmission direction of the high-frequency signal, and a second dielectric waveguide line 17 consisting of two rows of similar through conductor groups 4*b* are disposed, and a tip end of the first dielectric waveguide line 16 is perpendicularly connected to an opening 18 disposed in one side of the second dielectric waveguide line 17 with setting the width w of the opening 18 to be equal to the constant width d of the two rows of through conductor groups 4*a* and 4*b*. The through conductor groups in the other side opposed to the opening 18 of the through conductor groups 4*b* of the second dielectric waveguide line 17 are formed along two arcs 19 which are respectively centered at through conductors 18*a* at ends of the opening 18 and which have a radius equal to the constant width d, and have a vertex at an intersection 10 of the two arcs 19.

According to this configuration, the connection is performed while a recess having a vertex at the intersection 10 of the two arcs 19 is formed in the side wall opposed to the opening 18 of the second dielectric waveguide line 17. and a high-frequency signal is branched by the second dielectric waveguide line 17. Therefore, mismatching of the characteristic impedances in front and in rear of the branched portion is reduced.

The repetition intervals of the through conductors 3 along the arcs 19 constituting the recess are not more than one half of a signal wavelength of a high-frequency signal. According to this configuration, electrical side walls are formed.

Figure 9:
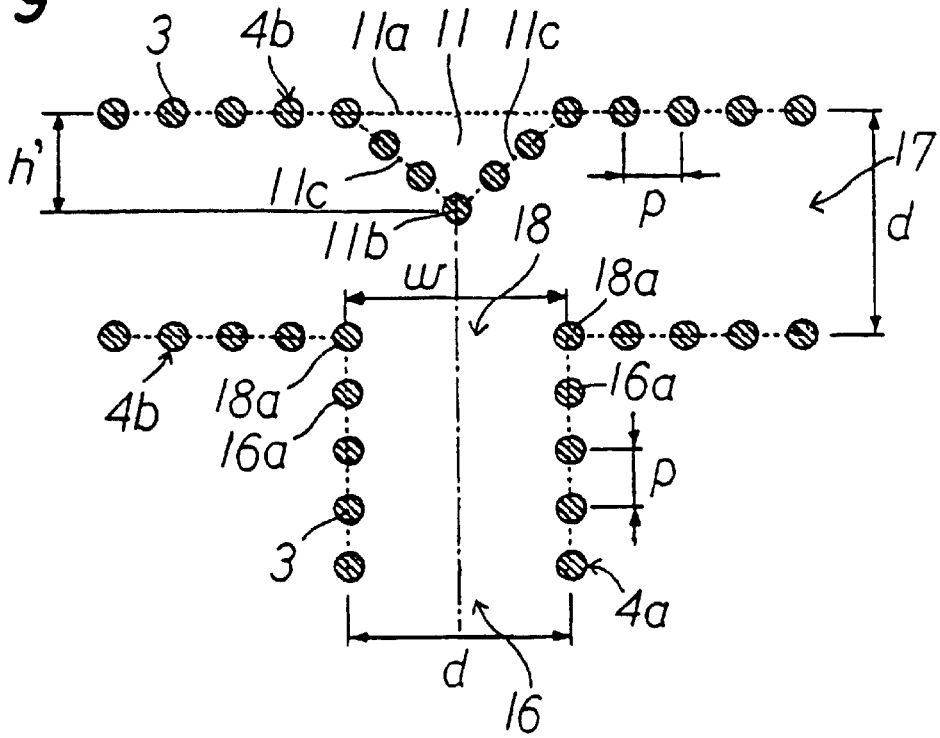
FIG. 9 is a plan view of a dielectric waveguide line having a T-branched portion according to an eighth embodiment of the invention.

A dielectric waveguide line having a T-branched portion according to an eighth embodiment of the present invention is shown in a plan view of FIG. 9. The T-branched portion is a branch structure of a dielectric waveguide line in which a first dielectric waveguide line 16 consisting of two rows of through conductor groups 4*a* which are formed to electrically connect conductor layers sandwiching a dielectric substrate with a constant width d in a direction perpendicular to the transmission direction of a high-frequency signal, to each other at repetition intervals p which are not more than one half of a signal wavelength of the high-frequency signal in the transmission direction of the high-frequency signal, and a second dielectric waveguide line 17 consisting of two rows of similar through conductor groups 4*b* are disposed, and a tip end of the first dielectric waveguide line 16 is perpendicularly connected to an opening 18 disposed in one side of the second dielectric waveguide line 17 with setting the width w of the opening 18 to be equal to the constant width d of the two rows of through conductor groups 4*a* and 4*b*. The through conductor groups in the other side opposed to the opening 18 of the through conductor groups 4*b* of the second dielectric waveguide line 17 are formed along oblique sides 11*c* of a triangle 11 which has a base 11*a* equal to the width w of the opening 18, a vertex 11*b* on the center line of the first dielectric waveguide line 16, and a height h' of d/2 or less.

According to this configuration, the connection is performed while a recess having a vertex at the vertex 11*b* of the triangle 11 is formed in the side wall opposed to the opening 18 of the second dielectric waveguide line 17, and a high-frequency signal is branched by the second dielectric waveguide line 17. Therefore, mismatching of the characteristic impedances in front and in rear of the branched portion is reduced.

Preferably, the height h' of the triangle 11 is $0<h'\leqq d/2$. when the height h' is larger than d/2, the reflection of a high-frequency signal is increased and the transmission loss tends to be increased. The repetition intervals of the through conductors 3 along the oblique sides 11*c* of the triangle 11 are not more than one half of a signal wavelength of a high-frequency signal. According to this configuration, electrical side walls are formed.

Figure 5:
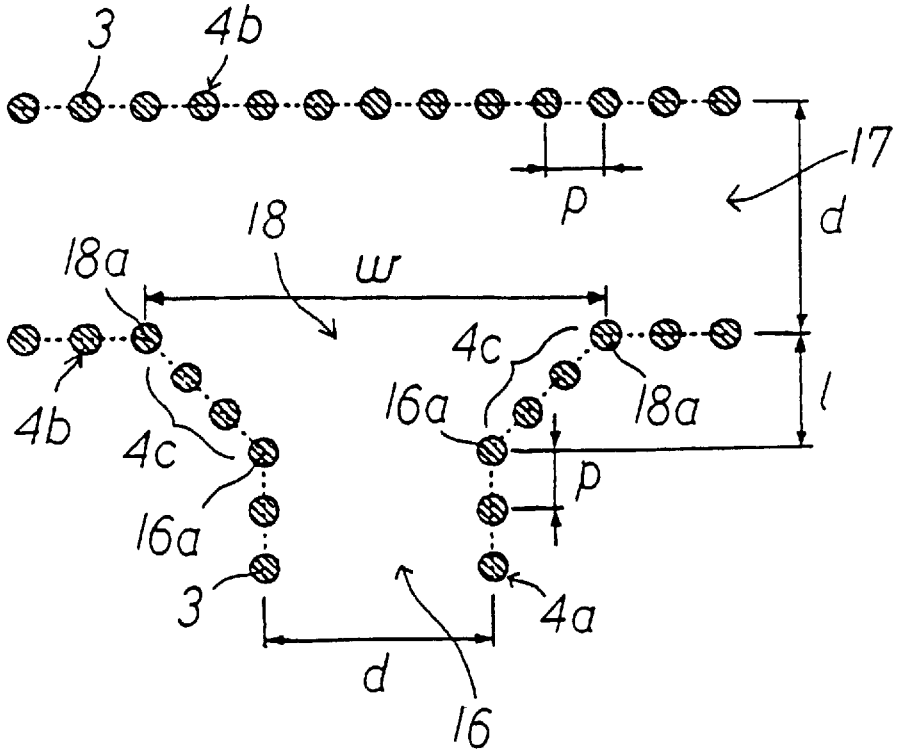
FIG. 5 is a plan view of a dielectric waveguide line having a T-branched portion according to a fourth embodiment of the invention.

A variation of a dielectric waveguide line having a T-branched portion shown in any of FIGS. 5, 6 and 7 is configured in the following manner. The through conductor groups in the other side opposed to the opening 18 of the through conductor groups 4*b* of the second dielectric waveguide line 17 are formed along two arcs which are respectively centered at the through conductors 18*a* at the ends of the opening 18 and which have a radius equal to the constant width d of the two rows of through conductor groups 4*a* and 4*b*, and have a vertex at an intersection of the two arcs. In other words, this variation is a combination of the T-branched portion shown in FIGS. 5–7 and the T-branched portion shown in FIG. 8.

According to this configuration, a high-frequency signal is branched by the second dielectric waveguide line 17, whereby the characteristic impedances in front and in rear of the branched portion are stepwise changed, and mismatching of the characteristic impedances is reduced. The combination of the two branch structures can attain larger effects than those of the case of a single branch structure.

Another variation of a dielectric waveguide line having a T-branched portion shown in any of FIGS. 5, 6 and 7 is configured in the following manner. The through conductor groups in the other side opposed to the opening 18 of the through conductor groups 4*b* of the second dielectric waveguide line 17 are formed along oblique sides of a triangle which has a base equal to the width w of the opening 18, a vertex on the center line of the first dielectric waveguide line 16, and a height of d/2 or less. In other words, this variation is a combination of the T-branched portion shown in FIGS. 5–7, and the T-branched portion shown in FIG. 9.

According to this configuration, a high-frequency signal is branched by the second dielectric waveguide line 17, whereby the characteristic impedances in front and in rear of the branched portion are stepwise changed, and mismatching of the characteristic impedances is reduced. The combination of the two branch structures can attain larger effects than those of the case of a single branch structure.

Figure 10:
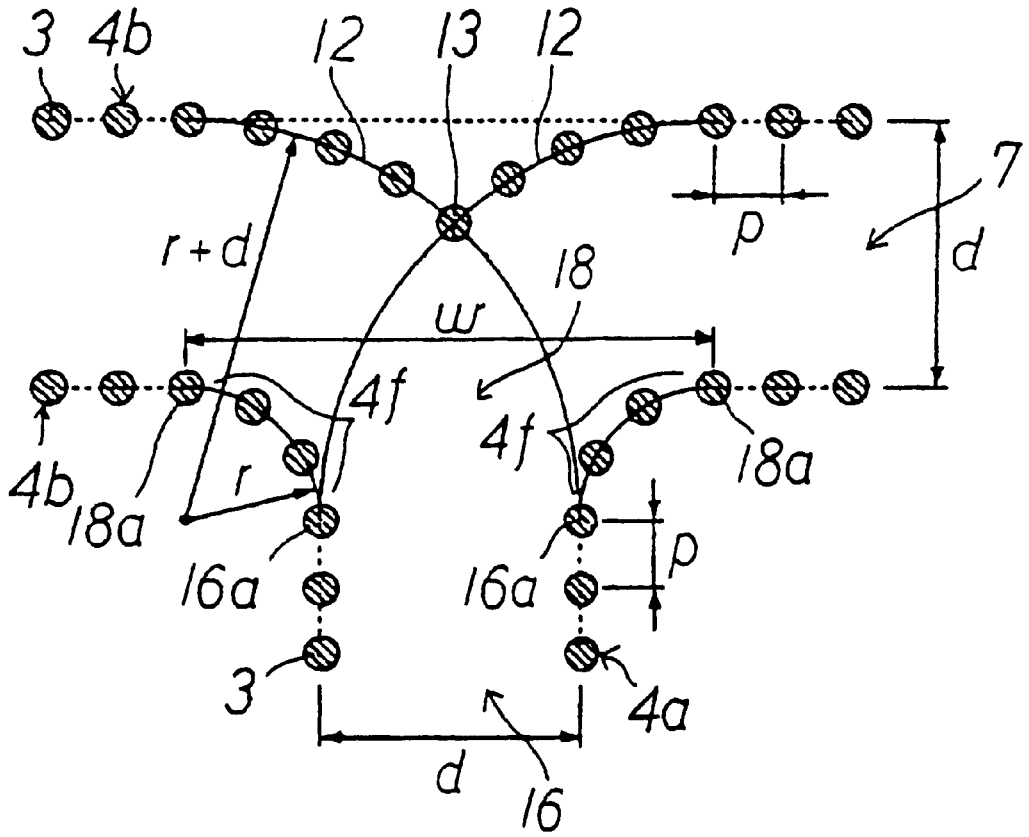
FIG. 10 is a plan view of a dielectric waveguide line having a T-branched portion according to a ninth embodiment of the invention.

A dielectric waveguide line having a T-branched portion according to a ninth embodiment of the present invention is shown in a plan view of FIG. 10. The T-branched portion is a branch structure of a dielectric waveguide line in which a first dielectric waveguide line 16 consisting of two rows of through conductor groups 4*a* which are formed to electrically connect conductor layers sandwiching a dielectric substrate with a constant width d in a direction perpendicular to the transmission direction of a high-frequency signal, to each other at repetition intervals p which are not more than one half of a signal wavelength of the high-frequency signal in the transmission direction of the high-frequency signal, and a second dielectric waveguide line 17 consisting of two rows of similar through conductor groups 4*b* are disposed, and a tip end of the first dielectric waveguide line 16 is connected to an opening 18 disposed in one side of the second dielectric waveguide line 17 with setting transmission directions of the lines to be perpendicular to each other. The width w of the opening 18 satisfies relationships of $d<w\leqq 2d$ with respect to the constant width d between the two rows of through conductor groups 4*a* and 4*b*. Through conductors 16*a* the tip end of the first dielectric waveguide line 16 are connected to through conductors 18*a* of the end of the opening 18 by connection through conductor groups 4*f* in which through conductors are arranged along arcs of a predetermined radius r. The through conductor groups in the other side opposed to the opening 18 of the through conductor groups 4*b* of the second dielectric waveguide line 17 are formed along two arcs 12 which are respectively concentric with the arcs of the connection through conductor groups 4*f* and which have a radius equal to a sum (r+d) of the radius r of the arcs and the constant width d between the two rows of through conductor groups 4*a* and 4*b*, and have a vertex at an intersection 13 of the two arcs 12.

According to this configuration, the first dielectric waveguide line 16 is connected to the second dielectric waveguide line 17 so that transmission directions of a high-frequency signal are perpendicular to each other, while the width of the transmission line of the first dielectric waveguide line 16 in front of the branch is changed by the connection through conductor groups 4*f* so as to be arcuately gradually widened, and a recess having a vertex at the intersection 13 of the two arcs 12 is formed in the side wall opposed to the opening 18 of the second dielectric waveguide line 17. In this structure, a high-frequency signal is branched by the second dielectric waveguide line 17, whereby mismatching of the characteristic impedances in front and in rear of the branched portion is reduced.

The case where the propagation mode of a high-frequency signal is $TE_{10}$ mode which is the mode of the lowest order will be considered. When the width d of the H plane of the waveguide is 2*a*, the relative magnetic permeability in the waveguide is $\mu_r$, the relative dielectric constant is $\in_r$, and the wavelength of an electromagnetic wave propagating through the waveguide is $\lambda$, the characteristic impedance of the waveguide is indicated by the following expression:

$$Z_m=[120\pi\sqrt{(\mu_r/\in_r)}\}/\sqrt{\{1-(\lambda/2a)^2\}}$$

When two time the width of the H plane of the waveguide is equal to the wavelength $\lambda$ of an electromagnetic wave propagating through the waveguide, therefore, the characteristic impedance $Z_m$ is infinite. As the wavelength $\lambda$ of an electromagnetic waive propagating through the waveguide becomes shorter than the width of the H plane of the waveguide, the characteristic impedance is smaller. When the wavelength $\lambda$ approaches 0, the characteristic impedance $Z_m$ is $120\pi\sqrt{(\mu_r/\in_r)}$.

In a T-branch, since one waveguide is branched into two waveguides, usually, the characteristic impedance $Z_m$ is changed in accordance with a change of the width of the waveguide, and reflection occurs, with the result that the transmission loss tends to be increased. By contrast, in the configuration shown in FIG. 10, reflection can be reduced in level so as to suppress the transmission loss, by realizing matching of the characteristic impedance $Z_m$ with setting the following relationship:

$$Z_{m2}=\sqrt{(Z_{m1}\cdot Z_{m3})}$$

where $Z_{m1}$ is the characteristic impedance immediately in front of the branched portion, $Z_{m2}$ is the characteristic impedance of the branched portion, and $Z_{m3}$ is the characteristic impedance immediately in rear of the branched portion.

Next, the configuration of a parallel-branched portion will be described. A dielectric waveguide line having a parallel-branched portion according to a tenth embodiment of the present invention is shown in a plan view of FIG. 11. In the embodiment, a first dielectric waveguide line 26 consisting of two rows of through conductor groups 14*a,* a second dielectric waveguide line 27 consisting of two rows of through conductor groups 14*b* and 14*d,* and a third dielectric waveguide line 28 consisting of two rows of through conductor groups 14*c* and 14*d* are disposed. The second and third dielectric waveguide lines 27 and 28 are disposed so as to share the through conductor group 14*d* of the one row. Through conductors 26*a* at a tip end of the first dielectric waveguide line 26 are connected to the through conductor groups 14*b* and 14*c* at ends of tip ends of the second and third dielectric waveguide lines 27 and 28 by connection through conductor groups 14*e* while the tip ends of the second and third dielectric waveguide lines 27 and 28 are opposed to the tip end of the first dielectric waveguide line 26 so that transmission directions of the high-frequency signal in the dielectric waveguide lines are parallel to each other.

According to this configuration, while the width d of the first dielectric waveguide line 26 in front of the branch is widened via the connection through conductor groups 14*e,* the first dielectric waveguide line 26 is connected to the second and third dielectric waveguide lines 27 and 28 so that the transmission directions of a high-frequency signal are parallel to each other, and a high-frequency signal is branched from the first dielectric waveguide line 26 into the second and third dielectric waveguide lines 27 and 28, whereby the width of the dielectric waveguide line is changed from the width d of the first dielectric waveguide line 26 to the width 2d of a connection dielectric waveguide line 29. Therefore. mismatching of the characteristic impedance in the branched portion can be made smaller than that in the case of a simple T-branch in which the width of the dielectric waveguide line is changed from the width d of the first dielectric waveguide line 26 to the width a ($2d \ll a < \infty$) of the connection dielectric waveguide line 29. The direction of the plane of the electric field of the same phase is not changed in front and in rear of the branch. Consequently, the reflection of a high-frequency signal in the branched portion can be reduced, with the result that the transmission loss can be reduced.

Figure 11:
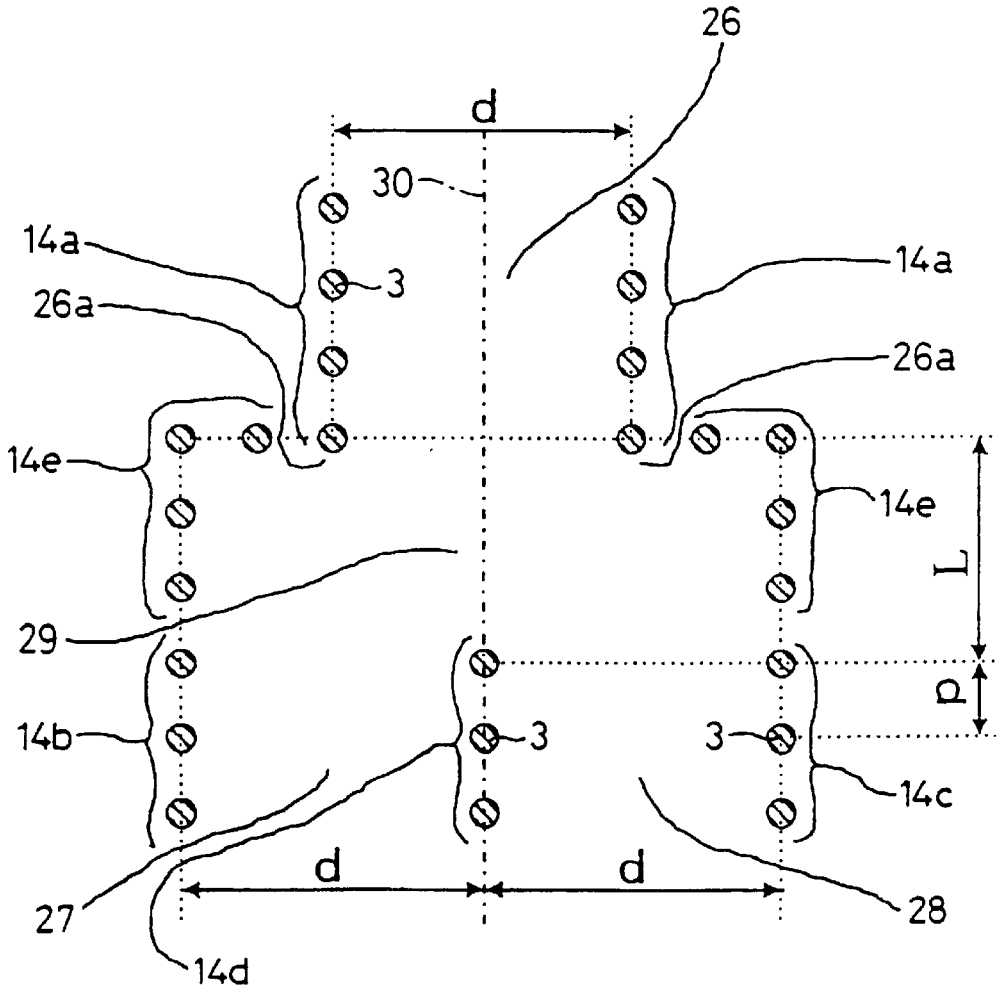
FIG. 11 is a plan view of a dielectric waveguide line having a parallel-branched portion according to a tenth embodiment of the invention.

FIG. 11 shows an example in which the center line 30 of the first dielectric waveguide line 26 coincides with the center line of the second and third dielectric waveguide lines 27 and 28, i.e., the straight line passing through the shared through conductor group 14*d.* In such a case, the easiness of the propagation of an electromagnetic wave from the first dielectric waveguide line 26 to the second and third dielectric waveguide lines 27 and 28 via the connection through conductor groups 14*e* (the connection dielectric waveguide line 29) is substantially identical. When the first dielectric waveguide line 26 in front of the branch is branched into the second and third dielectric waveguide lines 27 and 28, therefore, the power ratio after branch is about 1:1 or the evenly distributed branch is attained.

Figure 12:
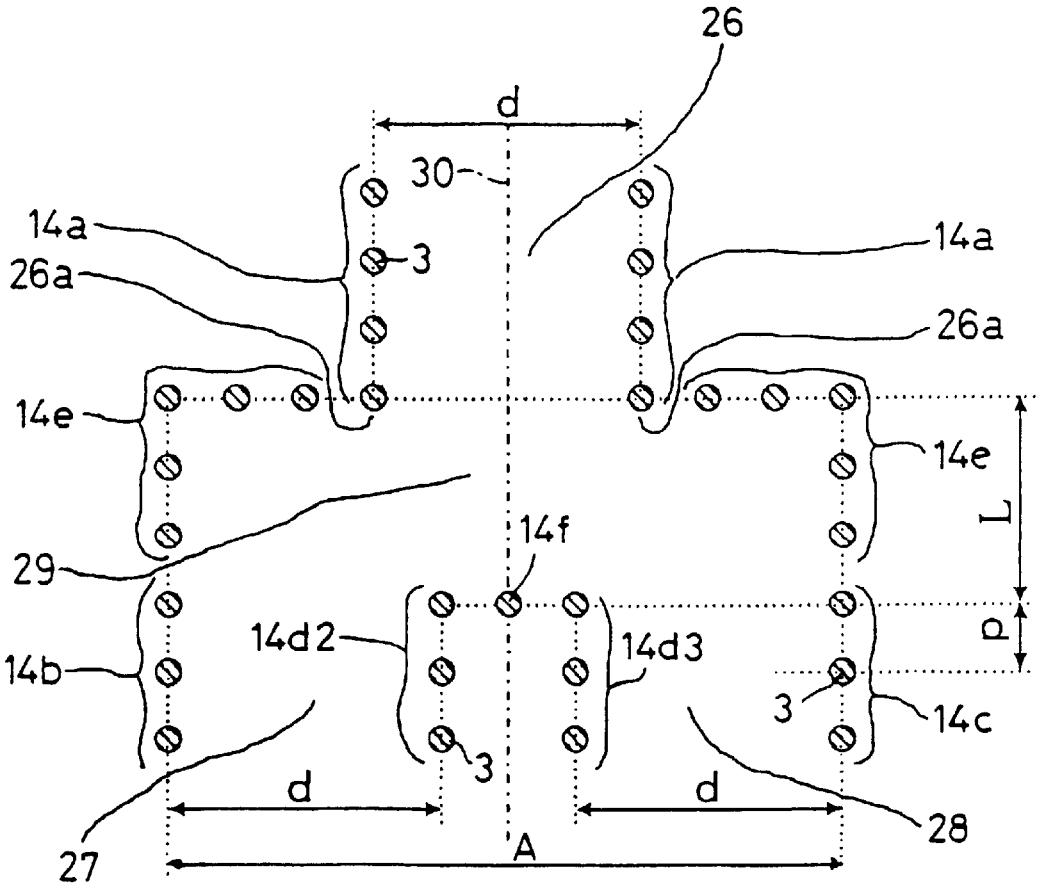
FIG. 12 is a plan view of a dielectric waveguide line having a parallel-branched portion according to an eleventh embodiment of the invention.

A dielectric waveguide line having a parallel-branched portion according to an eleventh embodiment of the present invention is shown in a plan view of FIG. 12. In the embodiment, a second dielectric waveguide line 27 consisting of two rows of through conductor groups 14*b* and 14*d*2, and a third dielectric waveguide line 28 consisting of two rows of through conductor groups 14*c* and 14*d*3 are disposed. The second and third dielectric waveguide lines 27 and 28 are arranged in parallel with aligning tip ends so that the distance A between outer through conductor groups 14*b* and 14*c* satisfies relationships of $2d < A \leqq 3d$ with respect to the constant width d. Tip ends of adjacent rows of through conductor groups 14*d*2 and 14*d*3 are connected to each other by an auxiliary connection through conductor group 14*f.* Through conductors 26*a* at a tip end of the first dielectric waveguide line 26 are connected to the through conductor groups 14*b* and 14*c* at ends of tip ends of the second and third dielectric waveguide lines 27 and 28 by connection through conductor groups 14*e* while the tip ends of the second and third dielectric waveguide lines 27 and 28 are opposed to the tip end of the first dielectric waveguide line 26 so that transmission directions of the high-frequency signal in the dielectric waveguide lines are parallel to each other.

According to this configuration, while the width d of the first dielectric waveguide line 26 in front of the branch is widened to the distance A which is $2d < A \leqq 3d$, via the connection through conductor groups 14*e,* the first dielectric waveguide line 26 is connected to the second and third dielectric waveguide lines 27 and 28 which are arranged in parallel to set the distance between the through conductor groups 14*b* and 14*c* at the ends to be equal to the distance A, so that the transmission directions of a high-frequency signal are parallel to each other, and a high-frequency signal is branched from the first dielectric waveguide line 26 into the second and third dielectric waveguide lines 27 and 28, whereby the width of the dielectric waveguide line is changed from the width d of the first dielectric waveguide line 26 to the width A of a connection dielectric waveguide line 29. Therefore, mismatching of the characteristic impedance in the branched portion can be made smaller than that in the case of a simple T-branch in which the width of the dielectric waveguide line is changed from the width d of the first dielectric waveguide line 26 to the width a ($2d \ll a < \infty$) of the connection dielectric waveguide line 29. The direction of the plane of the electric field of the same phase is not changed in front and in rear of the branch. Consequently, the reflection of a high-frequency signal in the branched portion can be reduced, with the result that the transmission loss can be reduced.

In this case, the second and third dielectric waveguide lines 27 and 28 are disposed with being separated from each other by a distance of (A−2d), and hence $S_{11}$ of S parameters is slightly lowered. However, the freedoms in design are enhanced and the isolation property also can be improved.

FIG. 12 shows an example in which, in the same manner as the example of FIG. 11, the center line 30 of the first dielectric waveguide line 26 coincides with the center line of the second and third dielectric waveguide lines 27 and 28. In such a case, the easiness of the propagation of an electromagnetic wave from the first dielectric waveguide line 26 to the second and third dielectric waveguide lines 27 and 28 via the connection through conductor groups 14*e* (the connection dielectric waveguide line 29) is substantially identical. Therefore, the power ratio after branch is about 1:1 or the evenly distributed branch is attained.

Figure 13:
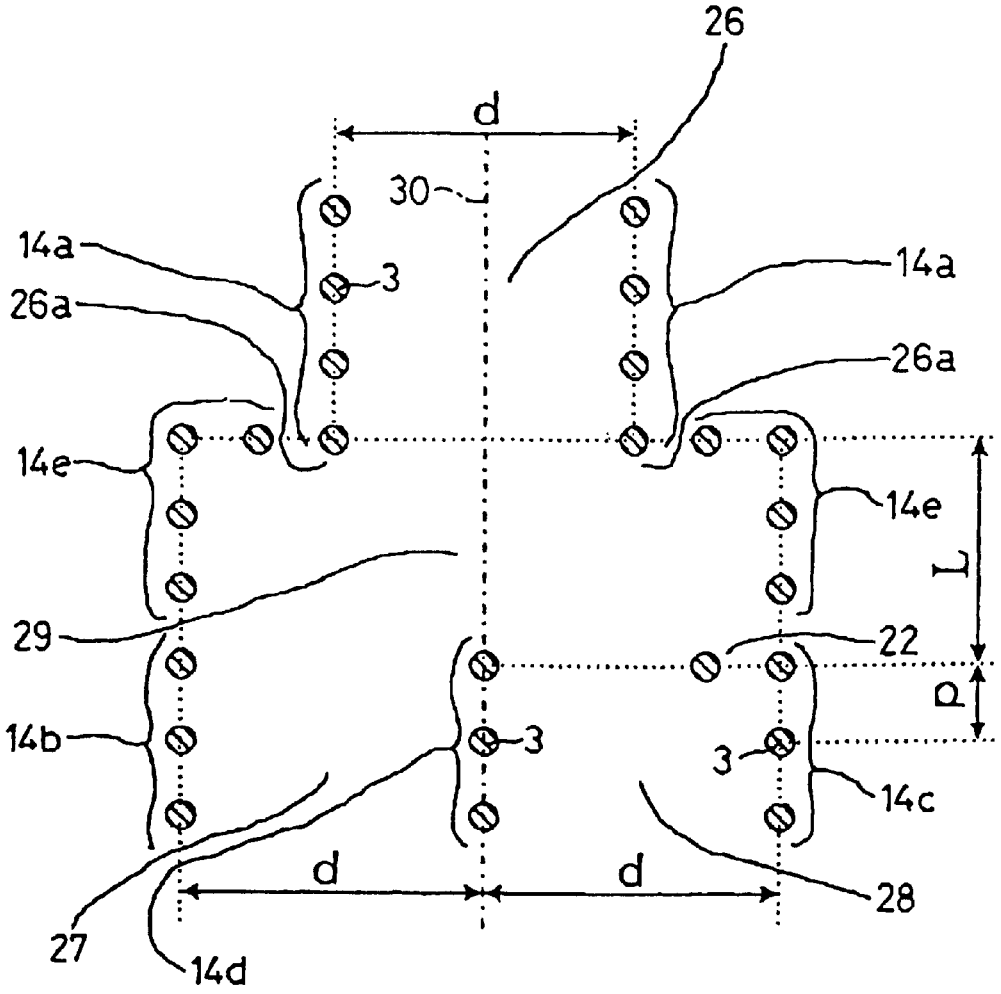
FIG. 13 is a plan view of a dielectric waveguide line having a parallel-branched portion according to a twelth embodiment of the invention.
Figure 14:
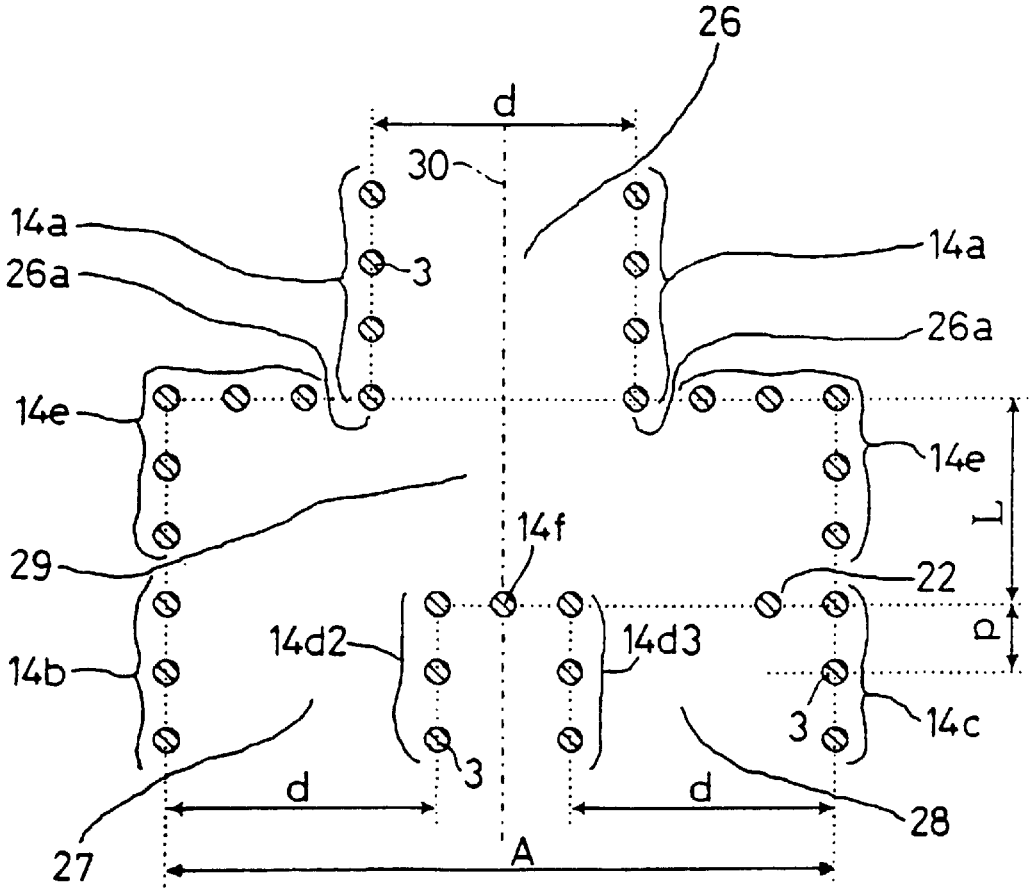
FIG. 14 is a plan view of another dielectric waveguide line having a parallel-branched portion according to a twelfth embodiment of the invention.

The structures shown in FIGS. 13 and 14 are variations of the structures shown in FIGS. 11 and 12, respectively.

The configuration of a parallel-branched portion shown in FIG. 13 is based on that of the parallel-branched portion shown in FIG. 11 and identical with that of FIG. 11 except that through conductors 22 are disposed in the third dielectric waveguide line 28, i.e., between the two rows of through conductor groups 14*c* and 14*d.* The components identical with those of FIG. 11 are designated by the same reference numerals.

According to this configuration, the characteristic impedance of the third dielectric waveguide line 28 is higher than the characteristic impedances of the first and second dielectric waveguide lines 26 and 27, and the cut-off frequency of the third dielectric waveguide line 28 becomes higher. In the case of $TE_{10}$ mode which is the mode of the lowest order of the waveguide, with respect to an electromagnetic wave which has propagated through the first dielectric waveguide line 26, therefore, a wave of a frequency between the cut-off frequency of the second dielectric waveguide line 27 and that of the third dielectric waveguide line 28 propagates through only the second dielectric waveguide line 27, and a wave of a frequency which is not lower than the cut-off frequency of the third dielectric waveguide line 28 propagates through both the second and third dielectric waveguide lines 27 and 28. Namely, in a range lower than a frequency at which a higher mode is produced, as the frequency is higher, an electromagnetic wave propagates more easily through the third dielectric waveguide line 28. As a result, when the first dielectric waveguide line 26 in front of the branch is branched into the second and third dielectric waveguide lines 27 and 28, the power ratio after branch is not 1:1 or the evenly distributed branch is not performed. Therefore, an arbitrary power ratio can be obtained by adequately selecting the position and the number of the through conductors 22 disposed in the third dielectric waveguide line 28.

The configuration of a parallel-branched portion shown in FIG. 14 is based on that of the parallel-branched portion shown in FIG. 12 and identical with that of FIG. 12 except that through conductors 22 are disposed in the third dielectric waveguide line 28. The components identical with those of FIG. 12 are designated by the same reference numerals.

According to this configuration, the characteristic impedance of the third dielectric waveguide line 28 is higher than the characteristic impedances of the first and second dielectric waveguide lines 26 and 27, and the cut-off frequency of the third dielectric waveguide line 28 becomes higher. With respect to an electromagnetic wave which has propagated through the first dielectric waveguide line 26, therefore, a wave of a frequency between the cut-off frequency of the second dielectric waveguide line 27 and that of the third dielectric waveguide line 28 propagates through only the second dielectric waveguide line 27, and a wave of a frequency which is not lower than the cut-off frequency of the third dielectric waveguide line 28 propagates through both the second and third dielectric waveguide lines 27 and 28. Namely, as the frequency is higher, an electromagnetic wave propagates more easily through the third dielectric waveguide line 28. As a result, when the first dielectric waveguide line 26 in front of the branch is branched into the second and third dielectric waveguide lines 27 and 28, the power ratio after branch is not 1:1 or the evenly distributed branch is not performed. Therefore, an arbitrary power ratio can be obtained by adequately selecting the position and the number of the through conductors 22 disposed in the third dielectric waveguide line 28.

Figure 15:
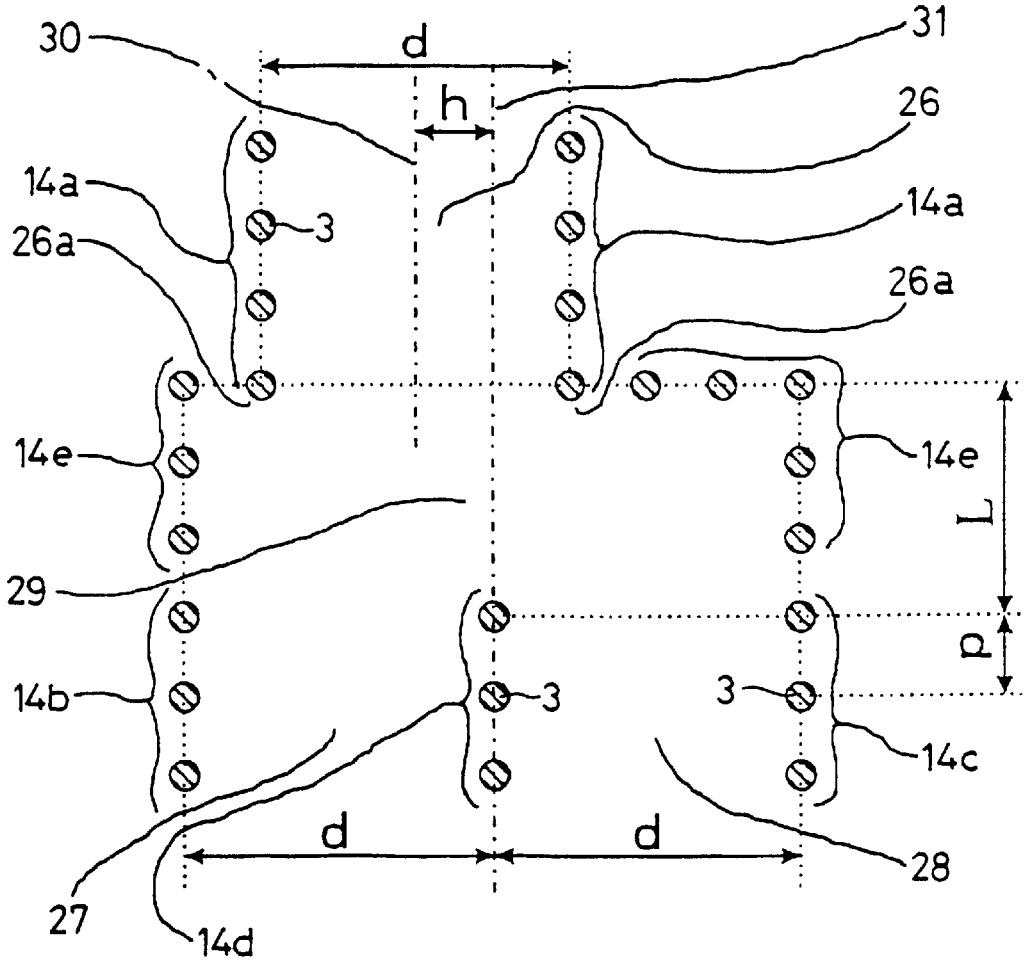
FIG. 15 is a plan view of a dielectric waveguide line having a parallel-branched portion according to a thirteenth embodiment of the invention.
Figure 16:
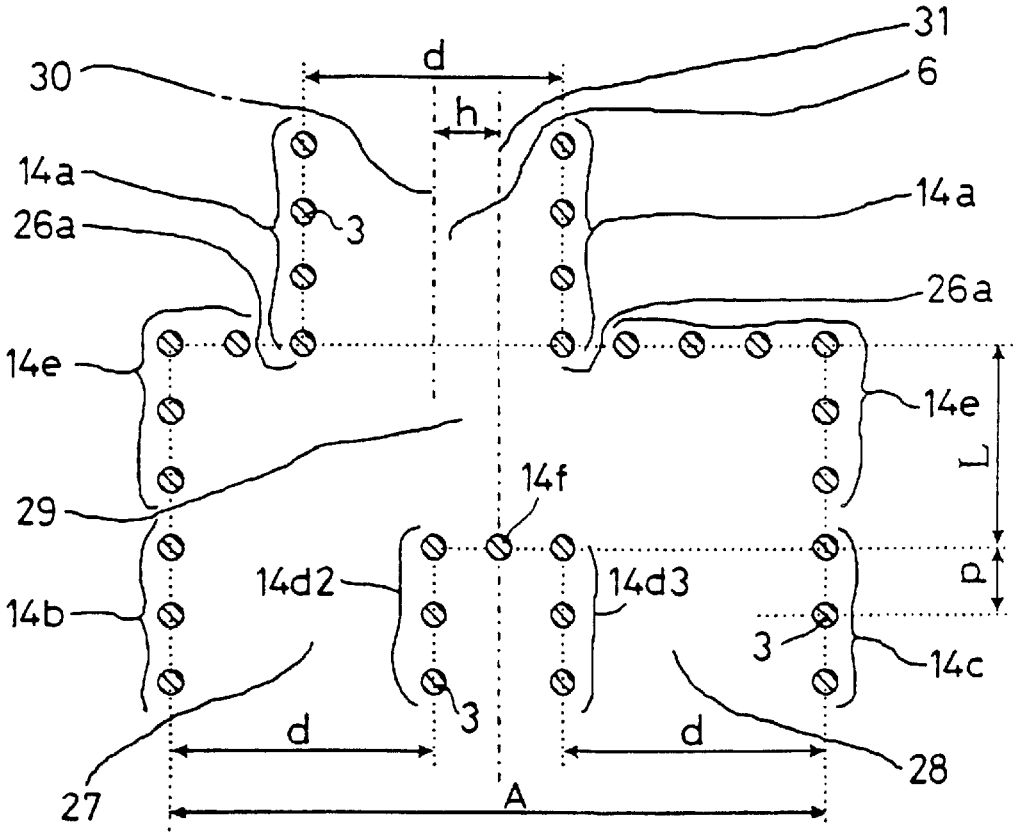
FIG. 16 is a plan view of another dielectric waveguide line having a parallel-branched portion according to a thirteenth embodiment of the invention.

The structures shown in FIGS. 15 and 16 are further variations of the structures shown in FIGS. 11 and 12, respectively.

The configuration of a parallel-branched portion shown in FIG. 15 is based on that of the parallel-branched portion shown in FIG. 11. In FIG. 15, the components identical with those of FIG. 11 are designated by the same reference numerals. The configuration is identical with that of FIG. 11 except that the center line 30 of the first dielectric waveguide line 26 is shifted from a position which coincides with the center line 31 of the second and third dielectric waveguide lines 27 and 28, i.e., a straight line 31 passing through the shared through conductor group 14*d*, by a distance h ($0<h<d/2$) toward the second dielectric waveguide line 27 in a direction perpendicular to the signal transmission direction.

According to this configuration, the characteristic impedance from the first dielectric waveguide line 26 to the second and third dielectric waveguide lines 27 and 28 via the connection through conductor groups 14*e* (the connection dielectric waveguide line 29) is little changed from that in the case where the center line 30 coincides with the straight line 31 passing through the through conductor group 14*d*. In accordance with the distance h, however, an electromagnetic wave more easily propagates through the second dielectric waveguide line 27. As a result, when the first dielectric waveguide line 26 in front of the branch is branched into the second and third dielectric waveguide lines 27 and 28, the power ratio after branch is not 1:1 or the evenly distributed branch is not performed. Therefore, an arbitrary power ratio can be obtained by adequately selecting the distance h by which the center line 30 of the first dielectric waveguide line 26 is shifted.

The configuration of a parallel-branched portion shown in FIG. 16 is based on that of the parallel-branched portion shown in FIG. 12. In FIG. 16, the components identical with those of FIG. 12 are designated by the same reference numerals. The configuration is identical with that of FIG. 12 except that the center line 30 of the first dielectric waveguide line 26 is shifted from a position which coincides with the center line 31 of the second and third dielectric waveguide lines 27 and 28, by a distance h ($0<h<d/2$) toward the second dielectric waveguide line 27 in a direction perpendicular to the signal transmission direction.

According to this configuration, the characteristic impedance from the first dielectric waveguide line 26 to the second and third dielectric waveguide lines 27 and 28 via the connection through conductor groups 14*e* (the connection dielectric waveguide line 29) is little changed from that in the case where the center line 30 coincides with the center line 31. In accordance with the distance h, however, an electromagnetic wave more easily propagates through the second dielectric waveguide line 27. As a result, when the first dielectric waveguide line 26 in front of the branch is branched into the second and third dielectric waveguide lines 27 and 28, the power ratio after branch is not 1:1 or the evenly distributed branch is not performed. Therefore, an arbitrary power ratio can be obtained by adequately selecting the distance h by which the center line 30 of the first dielectric waveguide line 26 is shifted.

It is suitable to set the length L in the signal transmission direction of the connection through conductor groups 14*e* (the connection dielectric waveguide line 29) which is indicated by L in FIGS. 11 through 16, to be $0<L\leqq d$. Preferably, also the repetition intervals of the through conductors in the connection through conductor groups 14*e* (the connection dielectric waveguide line 29) are not more than one half of a signal wavelength of a high-frequency signal. The connection through conductor groups 14*e* may be disposed so as to connect the tip end of the first dielectric waveguide line 26 to the ends of the tip ends of the second and third dielectric waveguide lines 27 and 28, in a straight-linear manner. Alternatively, the connection may be performed in an arcuate manner.

In the configuration of FIGS. 13 and 14, the through conductors 22 may be disposed at positions further inside the third dielectric waveguide line 28, in the second dielectric waveguide line 27, i.e., between the two rows of through conductor groups 14*b* and 14*d,* or in both the second and third dielectric waveguide lines 27 and 28. The embodiment may be combined with the configuration in which the center line 30 of the first dielectric waveguide line 26 is shifted from that of the second and third dielectric waveguide lines 27 and 28, so that the power ratio can be arbitrarily set.

Figure 17:
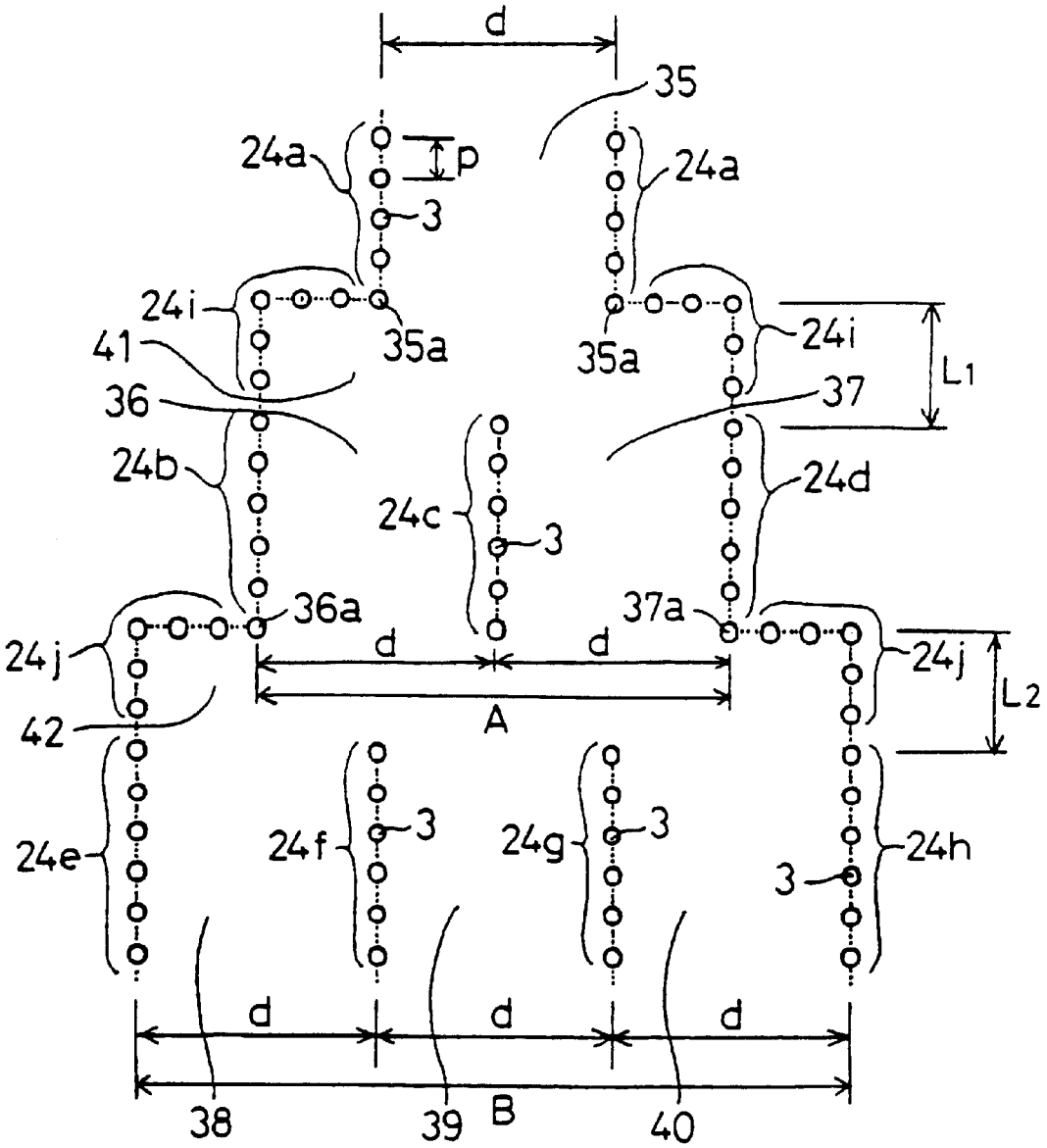
FIG. 17 is a plan view of a dielectric waveguide line having a parallel-branched portion according to a fourteenth embodiment of the invention.

A dielectric waveguide line having a parallel-branched structure according to a fourteenth embodiment of the present invention is shown in a plan view of FIG. 17. In the embodiment, a first dielectric waveguide line 35 consisting of two rows of through conductor groups 24*a,* a second dielectric waveguide line 36 consisting of two rows of through conductor groups 24*b* and 24*c,* a third dielectric waveguide line 37 consisting of two rows of through conductor groups 24*c* and 24*d,* a fourth dielectric waveguide line 38 consisting of two rows of through conductor groups 24*e* and 24*f,* a fifth dielectric waveguide line 39 consisting of two rows of through conductor groups 24*f* and 24*g,* and a sixth dielectric waveguide line 40 consisting of two rows of through conductor groups 24*g* and 24*h* are disposed. The second and third dielectric waveguide lines 36 and 37 are disposed so as to share the through conductor group 24*c* of the one row. Through conductors 35*a* at a tip end of the first dielectric waveguide line 35 are connected to the through conductor groups 24*b* and 24*d* at tip ends of the second and third dielectric waveguide lines 36 and 37 by connection through conductor groups 24*i* while the tip ends of the second and third dielectric waveguide lines 36 and 37 are opposed to the first dielectric waveguide line 35 so that transmission directions of a high-frequency signal in the dielectric waveguide lines are parallel to each other. The fourth and fifth dielectric waveguide lines 38 and 39 share the through conductor group 24*f* of the one row, and the fifth and sixth dielectric waveguide lines 39 and 40 share the through conductor group 24*g* of the one row. Through conductors 36*a* and 37*a* at tip ends of the second and third dielectric waveguide lines 36 and 37 are connected to the through conductor groups 24*e* and 24*h* at tip ends of the fourth and sixth dielectric waveguide lines 38 and 40 by connection through conductor groups 24*j* while the tip ends of the fourth, fifth, and sixth dielectric waveguide lines 38, 39, and 40 are opposed to the second and third dielectric waveguide lines 36 and 37 so that transmission directions of a high-frequency signal in the dielectric waveguide lines are parallel to each other.

According to this configuration, while the width d of the first dielectric waveguide line 35 in front of the branch is widened via the first connection through conductor groups 241, the first dielectric waveguide line 35 is connected to the second and third dielectric waveguide lines 36 and 37 so that the transmission directions of a high-frequency signal are parallel to each other, and, while the width 2*d* of the second and third dielectric waveguide lines 36 and 37 is widened via the second connection through conductor groups 24*j,* the second and third dielectric waveguide lines 36 and 37 are connected to the fourth to sixth dielectric waveguide lines 38 to 40 so that the transmission directions of a high-frequency signal are parallel to each other, and a high-frequency signal is branched from the first dielectric waveguide line 35 into the fourth to sixth dielectric waveguide lines 38 to 40 via the second and third dielectric waveguide lines 36 and 37. Therefore, one dielectric waveguide line can be branched into three dielectric waveguide lines by a compact structure. Since the branch is conducted via the first and second connection through conductor groups 24*i* and 24*j,* mismatching of the characteristic impedance due to branch can be made smaller. Consequently, the direction of the plane of the electric field of the same phase is not changed in front and in rear of the branch, and hence the reflection of a high-frequency signal in the branched portions can be reduced, with the result that a branch structure of a small transmission loss is realized.

Preferably, the length $L_1$ in the signal transmission direction of the first connection through conductor groups 24*i,* and the length $L_2$ in the signal transmission direction of the second connection through conductor groups 24*j* are set to be $0<L_1<d$ and $0<L_2<d$, respectively. Even when the lengths $L_1$ and $L_2$ are made not shorter than the constant width d, the effect of reducing mismatching of the characteristic impedance to suppress the reflection of a high-frequency signal in the branched portions is small.

In the same manner as the repetition intervals p in the dielectric waveguide lines 24*a* to 24*h,* preferably, the repetition intervals of the through conductors 3 of the first and second connection through conductor groups 24*i* and 24*j* are not more than one half of a signal wavelength of a high-frequency signal. According to this configuration, electrical side walls are formed also in the first and second connection dielectric waveguide lines 41 and 42.

The power ratio after branch from the first dielectric waveguide line 35 into the second and third dielectric waveguide lines 36 and 37, and that after branch from the second and third dielectric waveguide lines 36 and 37 into the fourth to sixth dielectric waveguide lines 38 to 40 can be set to have an arbitrary value without changing the characteristic impedances in the branched portions, respectively in accordance with the positional relationship between the center line of the first dielectric waveguide line 35 and that of the second and third dielectric waveguide lines 36 and 37, i.e., a straight line passing through the shared through conductor group 24*c,* and the positional relationship among the center lines of the second and third dielectric waveguide lines 36 and 37, the center line of the fourth and fifth dielectric waveguide lines 38 and 39 (the straight line passing through the through conductor group 24*f*), and that of the fifth and sixth dielectric waveguide lines 39 and 40 (the straight line passing through the through conductor group 24*g*). Namely, When the center lines are moved by the distance h ($0<h<d/2$) in a direction perpendicular to the signal transmission direction, the power ratio after branch can be arbitrarily set in accordance with the dogroo of the distance h.

For example, in the case where, as shown in FIG. 17, the center line of the first dielectric waveguide line 35 is made substantially coincident with that of the second and third dielectric waveguide lines 36 and 37, the center line of the second dielectric waveguide line 36 is made substantially coincident with that of the fourth and fifth dielectric waveguide lines 38 and 39, and the center line of the third dielectric waveguide line 37 is made substantially coincident with that of the fifth and sixth dielectric waveguide lines 39 and 40, when the first dielectric waveguide line 35 is branched into the second and third dielectric waveguide lines 36 and 37, the power ratio after branch is substantially 1:1 or the evenly distributed branch is performed, and, when the second and third dielectric waveguide lines 36 and 37 are branched into the fourth to sixth dielectric waveguide lines 38 to 40, the power ratio after branch is substantially 1:3:1. The value of the power ratio depends on the frequency of a signal.

Figure 18:
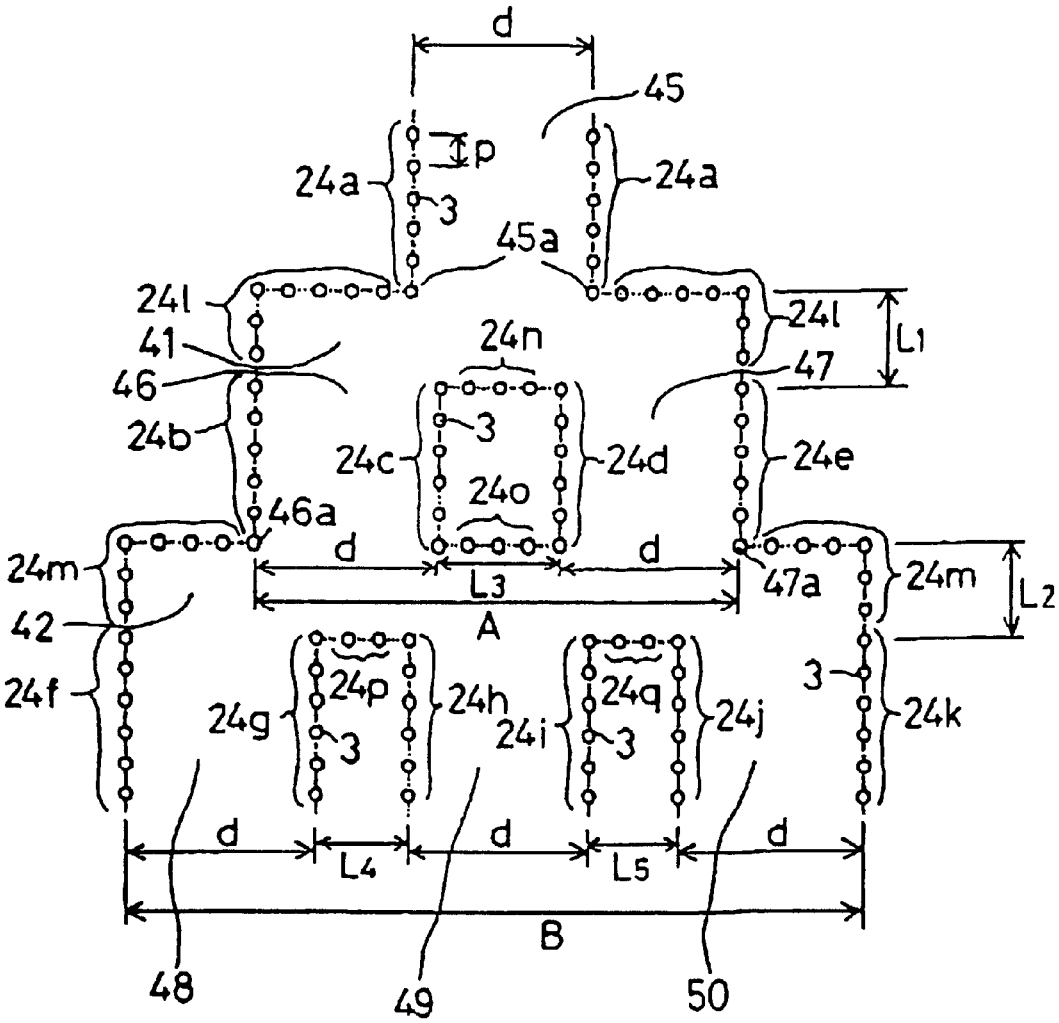
FIG. 18 is a plan view of another dielectric waveguide line having a parallel-branched portion according to a fourteenth of the invention.

Another dielectric waveguide line having a parallel-branched structure according to a fourteenth embodiment of the present invention is shown in a plan view of FIG. 18. In the embodiment, a first dielectric waveguide line 45 consisting of two rows of through conductor groups 24*a,* a second dielectric waveguide line 46 consisting of two rows of through conductor groups 24*b* and 24*c,* a third dielectric waveguide line 47 consisting of two rows of through conductor groups 24*d* and 24*e,* a fourth dielectric waveguide line 48 consisting of two rows of through conductor groups 24*f* and 24*g,* a fifth dielectric waveguide line 49 consisting of two rows of through conductor groups 24*h* and 24*i,* and a sixth dielectric waveguide line 50 consisting of two rows of through conductor groups 24*j* and 24*k* are disposed. The second and third dielectric waveguide lines 46 and 47 are arranged in parallel with aligning tip ends of one and other sides so that the distance A between the outer through conductor groups 24*b* and 24*e* satisfies relationships of $2d \leqq A \leqq 3d$ with respect to the constant width d. Tip ends of one and other sides of adjacent rows of the through conductor groups 24*c* and 24*d* are connected to each other by first and second auxiliary connection through conductor groups 24*n* and 24*o.* The fourth to sixth dielectric waveguide lines 48 to 50 are arranged in parallel with aligning tip ends of one side so that the distance B between the outer through conductor groups 24*f* and 24*k* of the fourth and sixth dielectric waveguide lines 48 and 50 satisfies relationships of $3d \leqq B \leqq 4d$ with respect to the constant width d. Tip ends of adjacent rows of the through conductor groups 24*g* and 24*h* of the fourth and fifth dielectric waveguide lines 48 and 49 are connected to each other by a fourth auxiliary connection through conductor group 24*p.* Tip ends of adjacent rows of the through conductor groups 24*i* and 24*j* of the fifth and sixth dielectric waveguide lines 49 and 50 are connected to each other by a fifth auxiliary connection through conductor group 24*q.* The dielectric waveguide lines 45 to 50 are arranged so that transmission directions of a high-frequency signal in the dielectric waveguide lines are parallel to each other.

The tip ends of one side of the first dielectric waveguide line 45 are connected to the ends of one side of the second and third dielectric waveguide lines 46 and 47 which are juxtaposed with opposing the one side so that transmission directions of a high-frequency signal are parallel to each other, by first connection through conductor groups 241. The first connection through conductor groups 241 are formed into a step-like shape by through conductor groups which are arranged with respect to through conductors 45*a* at the tip end of the first dielectric waveguide line 45 in a direction perpendicular to the signal transmission direction, and through conductor groups which are arranged as extensions of the through conductor groups 24*b* and 24*e.* The first connection through conductor groups 241 constitute the first connection dielectric waveguide line 41.

The ends of the tip ends of the other side of the second and third dielectric waveguide lines 46 and 47 are connected to the ends of one side of the fourth to sixth dielectric waveguide lines 48 to 50 which are juxtaposed with opposing the one side so that transmission directions of a high-frequency signal are parallel to each other, by second connection through conductor groups 24*m.* The second connection through conductor groups 24*m* are formed into a step-like shape by through conductor groups which are arranged with respect to through conductors 46*a* and 47*a* at the tip ends of the other side of the second and third dielectric waveguide lines 46 and 47 in a direction perpendicular to the signal transmission direction, and through conductor groups which are arranged as extensions of the through conductor groups 24*f* and 24*k.* The second connection through conductor groups 24*m* constitute the second connection dielectric waveguide line 42.

According to this configuration, while the width d of the first dielectric waveguide line 45 in front of the branch is widened to the distance A which is $2d \leqq A \leqq 3d$, via the first connection through conductor groups 24*l,* the first dielectric waveguide line 45 is connected to the second and third dielectric waveguide lines 46 and 47 which are arranged in parallel to set the distance between the through conductor groups 24*b* and 24*e* at the ends to be equal to the distance A, so that the transmission directions of a high-frequency signal are parallel to each other, and, while the width A of the second and third dielectric waveguide lines 46 and 47 is widened to the distance B which is $3d \leqq B \leqq 4d$, via the second connection through conductor groups 24*m,* the second and third dielectric waveguide lines 46 and 47 are connected to the fourth to sixth dielectric waveguide lines 48 to 50 which are arranged in parallel to set the distance between the ends to be equal to the distance B, so that the transmission directions of a high-frequency signal are parallel to each other, and a high-frequency signal is branched from the first dielectric waveguide line 45 into the fourth to sixth dielectric waveguide lines 48 to 50 via the second and third dielectric waveguide lines 46 and 47. Therefore, one dielectric waveguide line can be branched into three dielectric waveguide lines by a compact structure. Since the branch is conducted via the first and second connection through conductor groups 24*l* and 24*m,* mismatching of the characteristic impedance due to branch can be made smaller. Consequently, the direction of the plane of the electric field of the same phase is not changed in front and in rear of the branch, and hence the reflection of a high-frequency signal in the branched portions can be reduced, with the result that the transmission loss can be reduced.

The second and third dielectric waveguide lines 46 and 47 are arranged with being separated from each other by a distance of (A−2d), and the fourth to sixth dielectric waveguide lines 48 to 50 are arranged with being separated from one other by a distance which is obtained by dividing (B−3d) at an arbitrary ratio. Therefore, $S_{11}$ of S parameters is slightly lowered. However, the freedoms in design are enhanced and the isolation property also can be improved.

Preferably, the length $L_1$ in the signal transmission direction of the first connection through conductor groups 24*l,* and the length $L_2$ in the signal transmission direction of the second connection through conductor groups 24*m* are set to be $0<L_1<d$ and $0<L_2<d$, respectively. Even when the lengths $L_1$ and $L_2$ are made not shorter than the constant width d, the effect of reducing mismatching of the characteristic impedance to suppress the reflection of a high-frequency signal in the branched portions is small.

In the same manner as the repetition intervals p in the dielectric waveguide lines 24*a* to 24*k,* preferably, the repetition intervals of the through conductors 3 of the first and second connection through conductor groups 24*l* and 24*m* are not more than one half of a signal wavelength of a high-frequency signal. According to this configuration, electrical side walls are formed also in the first and second connection dielectric waveguide lines 41 and 42.

Preferably, the lengths $L_3$, $L_4$, and $L_5$ of the first to fourth auxiliary connection through conductor groups 24*n* to 24*q* are set to be $0<L_3<d$, $0<L_4<d$, and $0<L_5<d$, respectively. When the auxiliary connection through conductor groups 24*n* to 24*q* are made longer so as to exceed these ranges, there are occasions where the loss due to reflection is increased. It is preferable to set also the repetition intervals of the through conductors 3 of the first to fourth auxiliary connection through conductor groups 24*n* to 24*q* not to be more than one half of a signal wavelength of a high-frequency signal. According to this configuration, electrical side walls are formed also in the first to fourth auxiliary connection through conductor groups 24*n* to 24*q*.

The power ratio after branch from the first dielectric waveguide line 45 into the second and third dielectric waveguide lines 46 and 47, and that after branch from the second and third dielectric waveguide lines 46 and 47 into the fourth to sixth dielectric waveguide lines 48 to 50 can be set to have an arbitrary value without changing the characteristic impedances in the branched portions, respectively in accordance with the positional relationship between the center line of the first dielectric waveguide line 45 and that of the second and third dielectric waveguide lines 46 and 47, i.e., the center line between the second and third through conductor groups 24*c* and 24*d*, and the positional relationship among the center lines of the second and third dielectric waveguide lines 46 and 47, that of the fourth and fifth dielectric waveguide lines 48 and 49 (the center line between the through conductor groups 24*g* and 24*h*), and that of the fifth and sixth dielectric waveguide lines 49 and 50 (the center line between the through conductor groups 24*i* and 24*j*). Namely, when the center lines are moved by the distance h ($0<h<d/2$) in a direction perpendicular to the signal transmission direction, the power ratio after branch can be arbitrarily set in accordance with the degree of the distance h.

For example, in the case where, as shown in FIG. 18, the center line of the first dielectric waveguide line 45 is made substantially coincident with that of the second and third dielectric waveguide lines 46 and 47, the center line of the second dielectric waveguide line 46 is made substantially coincident with that of the fourth and fifth dielectric waveguide lines 48 and 49, and the center line of the third dielectric waveguide line 47 is made substantially coincident with that of the fifth and sixth dielectric waveguide lines 49 and 50, when the first dielectric waveguide line 45 is branched into the second and third dielectric waveguide lines 46 and 47, the power ratio after branch is substantially 1:1 or the evenly distributed branch is performed, and, when the second and third dielectric waveguide lines 46 and 47 are branched into the fourth to sixth dielectric waveguide lines 48 to 50, the power ratio after branch is substantially 1:3:1. The value of the power ratio depends on the frequency of a signal.

In the above, the embodiment of FIG. 17 wherein A=2d and B=3d, and that of FIG. 18 wherein A≠2d and B≠3d have been described. It is a matter of course that A and B can be arbitrarily set and combinedly used in the range of $2d \leqq A \leqq 3d$ and $3d \leqq B \leqq 4d$.

Figure 19:
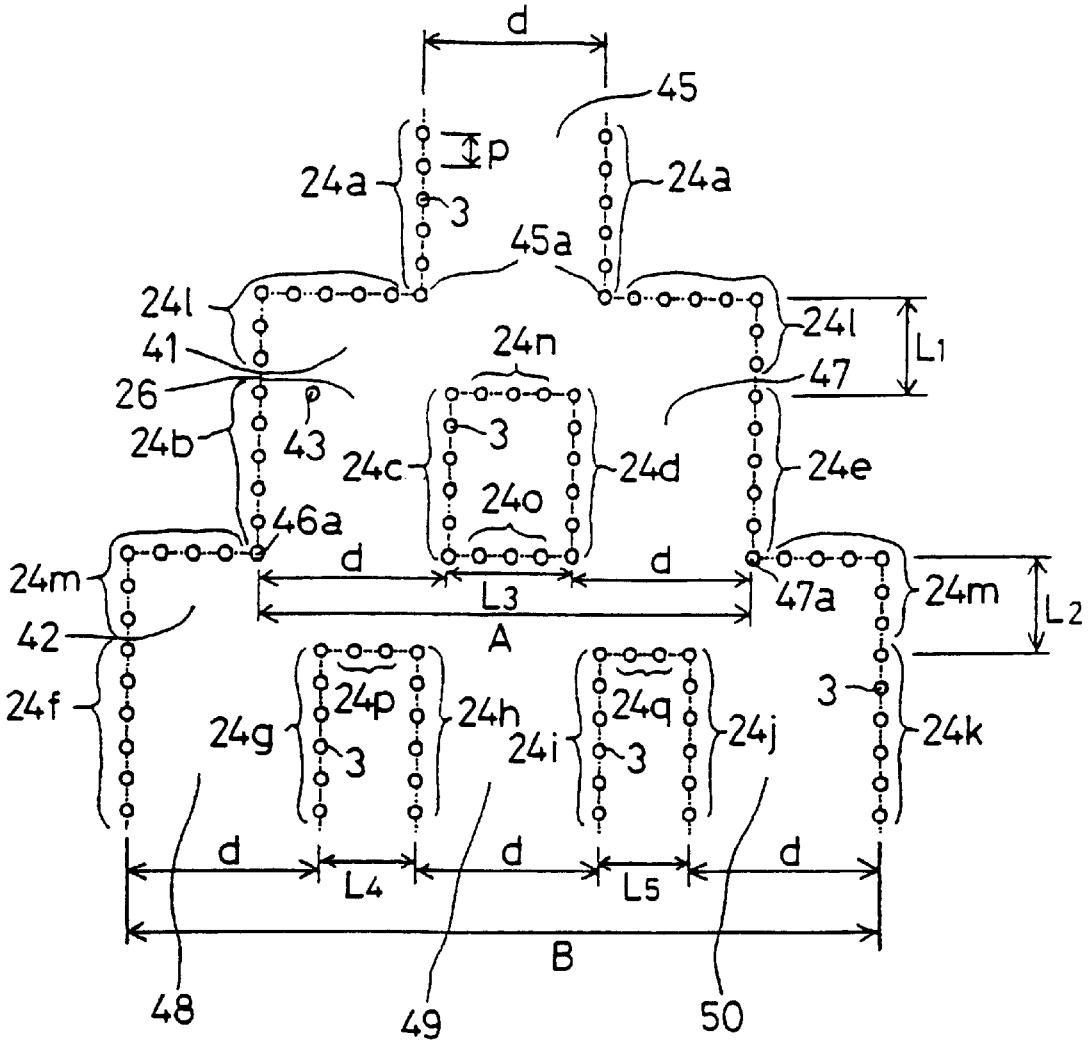
FIG. 19 is a plan view of a dielectric waveguide line having a parallel-branched portion according to a fifteenth embodiment of the invention.

A dielectric waveguide line having a parallel-branched structure according to a fifteenth embodiment of the present invention is shown in a plan view of FIG. 19. The configuration of the embodiment is identical with that of FIG. 18 except that through conductors 43 for adjusting the power ratio after branch are formed between the two rows of through conductor groups 24*b* and 24*c* of the second dielectric waveguide line 46. The components identical with those of FIG. 18 are designated by the same reference numerals.

According to this configuration, the cut-off frequency of the second dielectric waveguide line 46 in which the through conductors 43 are formed becomes higher. In the case of $TE_{10}$ mode which is the mode of the lowest order of the waveguide, a signal which is lower than the cut-off frequency of the second dielectric waveguide line 46 propagates through only the third dielectric waveguide line 47, and a signal which is not lower than the cut-off frequency propagates through both the second and third dielectric waveguide lines 46 and 47. Namely, in a range lower than a frequency at which a higher mode is produced, as the frequency is higher, the ratio of the signal propagation through the second dielectric waveguide line 46 is higher. As a result, when the first dielectric waveguide line 45 in front of the branch is branched into the second and third dielectric waveguide lines 46 and 47, the power ratio after branch is not 1:1 or the evenly distributed branch is not performed. Therefore, the powers after branch can be adjusted to an arbitrary power ratio by adequately selecting the position and the number of the through conductors 43 disposed in the second dielectric waveguide line 46.

The through conductors 43 for adjusting the power ratio after branch may be formed in any one of the other dielectric waveguide lines 47 to 50, in plural ones of the dielectric waveguide lines 46 to 50, or in the connection dielectric waveguide lines 41 and 42. This configuration may be combined with that in which the center lines of the through conductor groups 24*c* and 24*d*, 24*g* and 24*h*, and 24*j* and 24*k* are shifted, so that an arbitrary power ratio is obtained.

EXAMPLE 1

With respect to a dielectric waveguide line having a bent portion of the configuration shown in FIG. 2, transmission characteristics of the transmission line were calculated according to the finite element method. The frequency characteristics of S parameters were calculated while, as the materials of the conductor layers 2 and the through conductors 3, pure copper having a conductivity of $5.8\times10^7$ (1/Ωm) was used, and, as the dielectric substrate 1, used was a glass-ceramics sintered body which has a relative dielectric constant of 5 and a dielectric loss tangent of 0.001 and which was produced by firing 75 wt. % of borosilicate glass and 25 wt. % of alumina, and the thickness of the dielectric substrate 1 was set to be a=1 mm, the diameter of the through conductors 3 to be 0.16 mm, the repetition intervals of the through conductor groups 4 to be p=1.58 mm, the constant width of the through conductor groups 4 to be d=2 mm (conforming to WRJ-34 standard), and the length of the line to be 30 mm.

As a result, it was seen that the cut-off frequency is about 42 GHz and a signal which is not lower than the frequency can satisfactorily transmit through the line. Furthermore, It was also seen that the electric field distribution in the outlet of the bent portion is similar to that in the inlet the effect of the bent portion on the electric field distribution is limited to the inside of the bent portion, the electric field strength is not distributed outside the transmission line in the bent portion, and hence radiation of an electromagnetic wave due to the bent portion does not occur.

Samples of a dielectric waveguide line having the above configuration were produced and their transmission characteristics were evaluated. As a result, excellent transmission characteristics which are similar to the above calculation results were obtained.

Furthermore, in dielectric waveguide lines respectively having bent portions of the configurations shown in FIGS. 3 and 4, evaluation of transmission characteristics was similarly conducted by calculation according to the finite element method, and on produced samples. In all the cases, it was confirmed that radiation of an electromagnetic wave due to the bent portion does not occur and the waveguide line has excellent transmission characteristics.

EXAMPLE 2

With respect to a dielectric waveguide line having a T-branched portion of the configuration shown in FIG. 9, transmission characteristics of the transmission line were calculated according to the finite element method. The frequency characteristics of S parameters were calculated while, as the materials of the conductor layers 2 and the through conductors 3, pure copper having a conductivity of $5.8\times10^7$ (1/Ωm) was used, and as the dielectric substrate 1, used was a glass-ceramics sintered body which has a relative dielectric constant of S and a dielectric loss tangent of 0.001 and which was produced by firing 75 wt. % of borosilicate glass and 25 wt. % of alumina, and the thickness of the dielectric substrate 1 was set to be a=1 mm, the diameter of the through conductors 3 to be 0.16 mm, the repetition intervals of the through conductor groups 4 to be p=1.58 mm, the constant width of the through conductor groups 4 to be d=2 mm (conforming to WRJ-34 standard), the height of the triangle 11 to be h'=0.5 mm, and the length of the line to be 30 mm.

Figure 20:
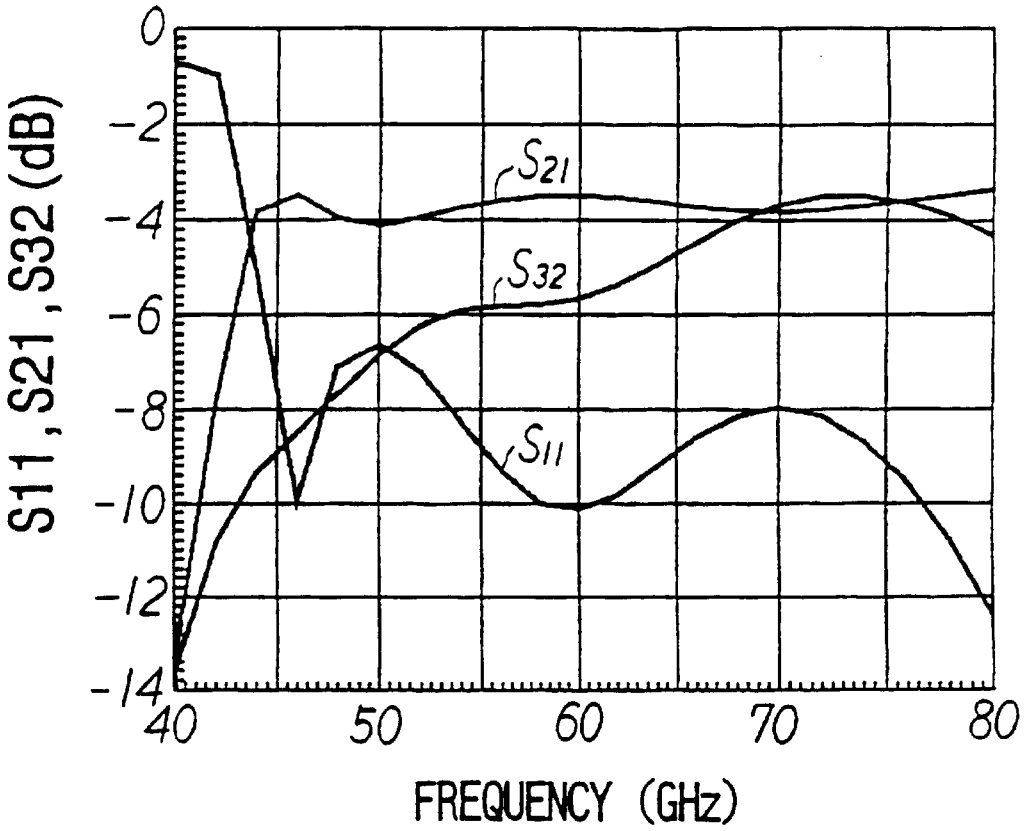
FIG. 20 is a graph showing frequency characteristics of S parameters in the dielectric waveguide line having a T-branched portion according to the eight embodiment of the invention.

The results are shown in a graph of FIG. 20. In FIG. 20, the abscissa indicates the frequency (GHz) and the ordinate indicates the values (dB) of $S_{11}$, $S_{21}$ and $S_{32}$ of S parameters. The characteristic curves in the figure show the frequency characteristics of the respective S parameters. From the results, it is seen that the cut-off frequency is about 42 GHz which is substantially equal to a theoretical value and a signal which is not lower than the frequency can satisfactorily transmit through the line.

The electric field distribution in the T-branched portion was checked according to the finite element method. As a result, it was seen that, although the shape of the electric field distribution is changed in the branched portion, the electric field distribution in the outlet of the branched portion is similar to that in the inlet, the effect of the branch on the electric field distribution is limited to the inside of the branched portion, the electric field strength is not distributed outside the transmission line in the branched portion, and hence radiation of an electromagnetic wave due to the branch does not occur.

EXAMPLE 3

With respect to a dielectric waveguide line having a T-branched portion of the configuration shown in FIG. 7, transmission characteristics of the transmission line were calculated according to the finite element method, and the frequency characteristics of S parameters were calculated in the same manner as Example 2 except that the width of the opening 18 was set to be w=4 mm and the length of the connection through conductor groups 4*e* to be h=0.67 mm.

Figure 21:
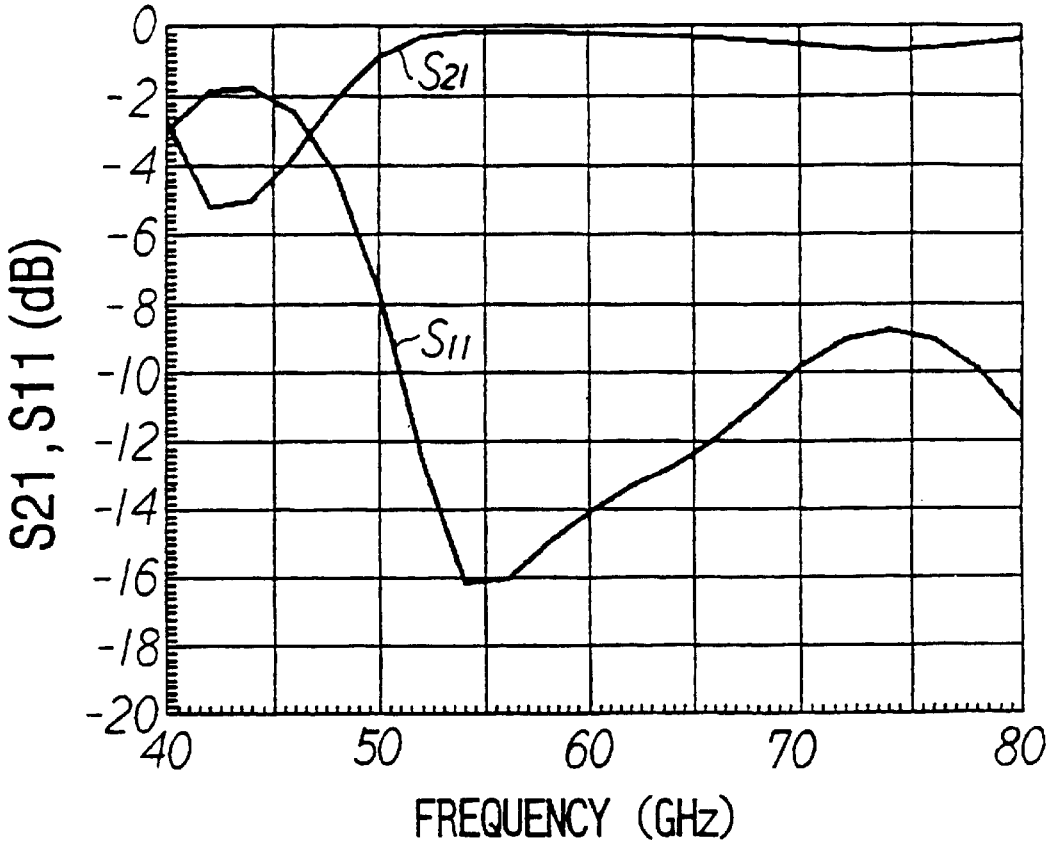
FIG. 21 is a graph showing frequency characteristics of S parameters in the dielectric waveguide line having a T-branched portion according to the sixth embodiment of the invention.

The results are shown in a graph of FIG. 21. In FIG. 21, the abscissa indicates the frequency (GHz) and the ordinate indicates the values (dB) of $S_{11}$ and $S_{21}$ of S parameters. The characteristic curves in the figure show the frequency characteristics of the respective S parameters. A value of $S_{21}$ is obtained by subtracting 3 dB from the relevant value in the curves. From the results, it is seen that, in the same manner as Example 2, satisfactory results were obtained, the reflectivity is smaller as compared with Example 2, and matching of the characteristic impedances in front and in rear of the branch is satisfactorily performed.

In the same manner as Example 2, also in this example, the electric field distribution in the T-branched portion was checked. As a result, it was seen that, although the shape of the electric field distribution is changed in the branched portion, the electric field distribution in the outlet of the branched portion is similar to that in the inlet, the effect of the branch on the electric field distribution is limited to the inside of the branched portion, the electric field strength is not distributed outside the transmission line in the branched portion, and hence radiation of an electromagnetic wave due to the branch does not occur.

EXAMPLE 4

With respect to the branch structure of a dielectric waveguide line having a parallel-branched portion of the configuration shown in FIG. 11, transmission characteristics of the transmission line having a branch in which the center lines coincide with each other were calculated according to the finite element method. The frequency characteristics of S parameters were calculated while, as the materials of the conductor layers 2 and the through conductors 3, pure copper having a conductivity of $5.8\times10^7$ (1/Ωm) was used, and, as the dielectric substrate 1, used was a glass-ceramics sintered body which has a relative dielectric constant of 5 and a dielectric loss tangent of 0.001 and which was produced by firing 75 wt. % of borosilicate glass and 25 wt. % of alumina, and the thickness of the dielectric substrate 1 was set to be a=0.62 mm, the diameter of the through conductors 3 to be 0.1 mm, the repetition intervals of the through conductors 3 to be p=0.25 mm, the constant width of the through conductor groups 14 to be d=1.2 mm, and the lengths of the first to third dielectric waveguide lines 26 to 28 to be 2.25 mm.

Figure 22:
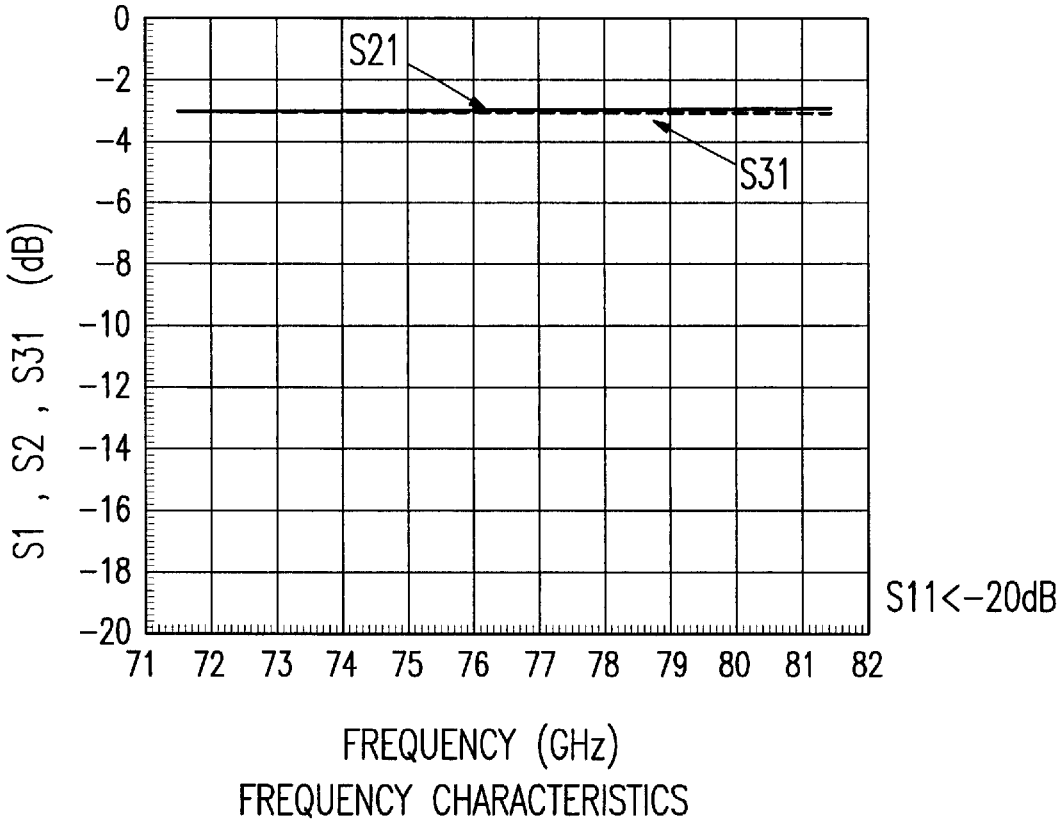
FIG. 22 is a graph showing frequency characteristics of S parameters in the dielectric waveguide line having a parallel-branched portion according to the tenth embodiment of the invention.

The results are shown in a graph of FIG. 22. In FIG. 22, the abscissa indicates the frequency (GHz) and the ordinate indicates the values (dB) of $S_{11}$, $S_{21}$ and $S_{31}$ of S parameters. The characteristic curves in the figure show the frequency characteristics of the respective S parameters. The cut-off frequency is about 42 GHz, which is substantially equal to a theoretical value, and signals which are not lower than the frequency satisfactorily transmit through the line. It is seen from the results that the ratio of $S_{21}$ to $S_{31}$ is substantially constant or 1:1 in the frequency range which was subjected to the calculation. The value of $S_{11}$ is not more than −20 dB.

EXAMPLE 5

With respect to the branch structure of a dielectric waveguide line having a parallel-branched portion of the configuration shown in FIG. 15, transmission characteristics of the transmission line having a branch in which the center lines do not coincide with each other were calculated according to the finite element method. The frequency characteristics of S parameters were calculated while, so the materials of the conductor layers 2 and the through conductors 3, pure copper having a conductivity of $5.8\times10^7$ (1/Ωm) was used, and, as the dielectric substrate 1, used was a glass-ceramics sintered body which has a relative dielectric constant of 5 and a dielectric loss tangent of 0.001 and which was produced by firing 75 wt. % of borosilicate glass and 25 wt. % of alumina, and the thickness of the dielectric substrate 1 was set to be a=0.62 mm, the diameter of the through conductors 3 to be 0.1 mm, the repetition intervals of the through conductor groups 4 to be p=0.25 mm, the constant width of the through conductor groups 4 to be d=1.2 mm, the shift distance of the center lines to be h=0.15 mm. and the length of the line to be 2.25 mm.

Figure 23:
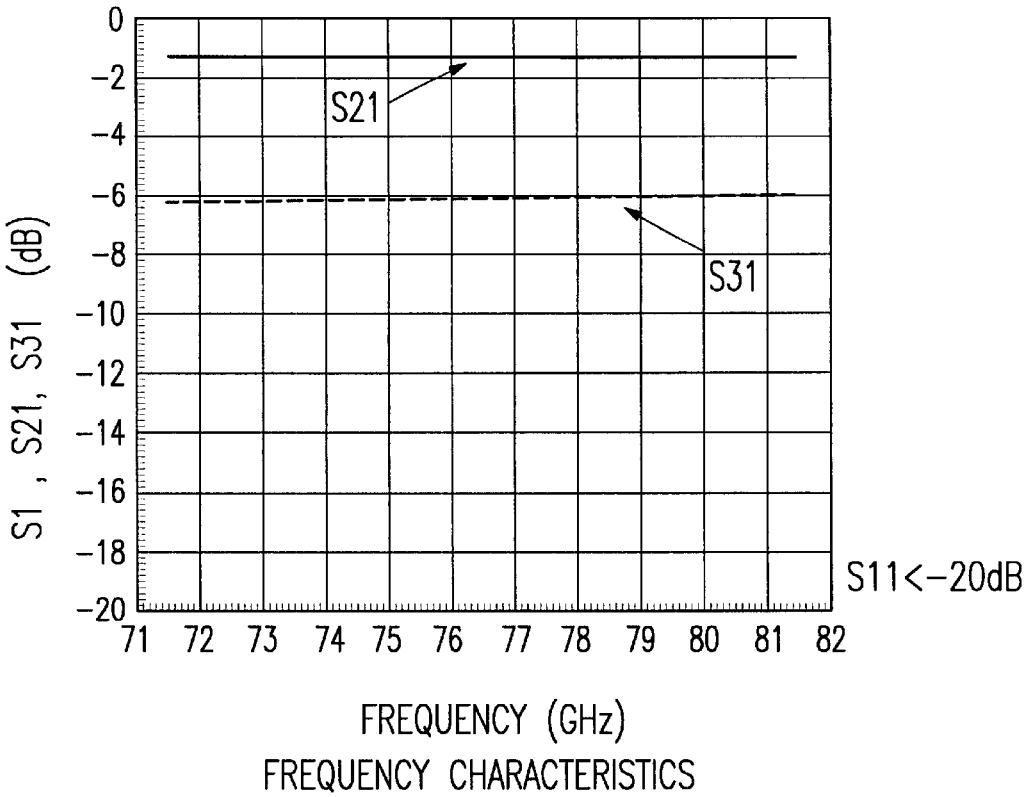
FIG. 23 is a graph showing frequency characteristics of S parameters in the dielectric waveguide line having a parallel-branched portion according to the thirteenth embodiment of the invention.

The results are shown in a graph of FIG. 23. In FIG. 23, the abscissa indicates the frequency (GHz) and the ordinate indicates the values (dB) of $S_{21}$ and $S_{31}$ of S parameters. The characteristic curves in the figure show the frequency characteristics of the respective S parameters.

The cut-off frequency is about 42 GHz, which is substantially equal to a theoretical value, and signals which are not lower than the frequency satisfactorily transmit through the line. It is seen from the results that the ratio of $S_{21}$ to $S_{31}$ is substantially constant or 5:1 in the frequency range which was subjected to the calculation. The value of $S_{11}$ is not more than −20 dB.

EXAMPLE 6

With respect to the branch structure of a dielectric waveguide line having a parallel-branched portion of the configuration shown in FIG. 17, transmission characteristics of the transmission line having a branch were calculated according to the finite element method. The frequency characteristics of S parameters were calculated while, as the materials of the conductor layers 2 and the through conductors 3, pure copper having a conductivity of $5.8\times10^7$ (1/Ωm) was used, and, as the dielectric substrate 1, used was a glass-ceramics sintered body which has a relative dielectric constant $\in_r$ of 5 and a dielectric loss tangent tan δ of 0.001 and which was produced by firing 75 wt. % of borosilicate glass and 25 wt. % of alumina, and the thickness of the dielectric substrate 1 was set to be a=0.62 mm, the diameter of the through conductors 3 to be 0.1 mm, the repetition intervals of the through conductor groups 4 to be p=0.25 mm, the constant width of the through conductor groups 4 to be d=1.2 mm, and the lengths of the first to sixth dielectric waveguide lines 35 to 40 to be 2.25 mm.

Figure 24:
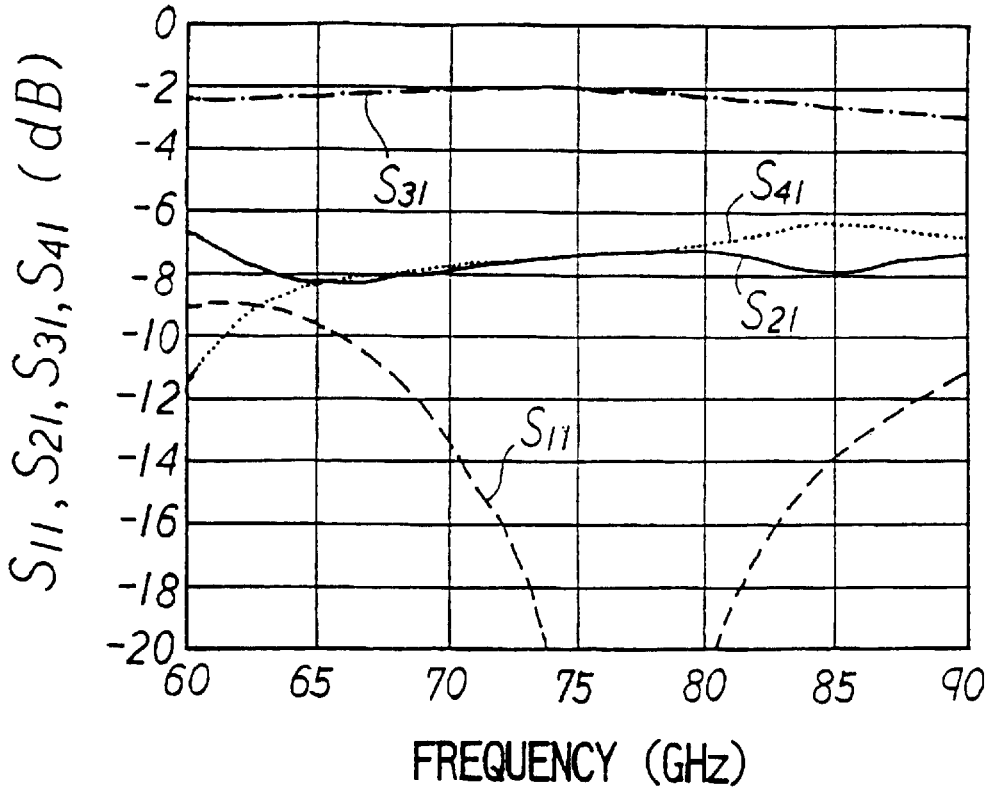
FIG. 24 is a graph showing frequency characteristics of S parameters in the dielectric waveguide line having a parallel-branched portion according to the fourteenth embodiment of the invention.

The results are shown in a graph of FIG. 24. In FIG. 24, the abscissa indicates the frequency (GHz) and the ordinate indicates the values (dB) of $S_{11}$, $S_{21}$, $S_{31}$ and $S_{41}$ of S parameters. The characteristic curves in the figure show the frequency characteristics of the respective S parameters. In the graph, $S_{11}$ indicates the component which enters the first dielectric waveguide line 35 and exits from the first dielectric waveguide line 35, $S_{21}$ indicates the component which enters the first dielectric waveguide line 35 and exits from the fourth dielectric waveguide line 38, $S_{31}$ indicates the component which enters the first dielectric waveguide line 35 and exits from the fifth dielectric waveguide line 39, and $S_{41}$ indicates the component which enters the first dielectric waveguide line 35 and exits from the sixth dielectric waveguide line 40.

From the results, it is seen that $S_{11}$ is −10 dB of less in 66 to 90 GHz, the reflection of a signal is small particularly in the vicinity of 77 GHz or a frequency at which the length $L_1$ of the first connection through conductor groups **24*i* (the first connection dielectric waveguide line 41) corresponds to one quarter of the guide wavelength of the dielectric waveguide line, and a high-frequency signal can satisfactorily transmit through the first dielectric waveguide line 35 serving as an inlet. The ratio of the output powers from the three dielectric waveguide lines 38, 39 and 40** serving as outlets is 3:10:3 at 77 GHZ.

Next, the frequency characteristics of S parameters were similarly checked while the center line of the second and third dielectric waveguide lines 36 and 37 was shifted with respect to that of the first dielectric waveguide line 35, by d/10 in a leftward direction in the figure which is perpendicular to the line. As a result, it was confirmed that the ratio of the output powers from the fourth to sixth dielectric waveguide lines 38 to 40 is 6:10:3 at 77 GHz and the power ratio after branch can be adjusted.

Next, the frequency characteristics of S parameters were similarly checked while the through conductors 43 were formed at the tip end of the second dielectric waveguide line 36 or at positions separated from the through conductor groups 4b by d/10 in a direction which is perpendicular to the line. As a result, it was confirmed that the ratio of the output powers from the fourth to sixth dielectric waveguide lines 38 to 40 is 5:12:3 at 77 GHz and the power ratio after branch can be adjusted.

Furthermore, also a dielectric waveguide line having a parallel-branched portion of the configuration shown in FIG. 19 was evaluated by similarly obtaining the frequency characteristios of S parameters. As a result, it was confirmed that, in all cases, excellent transmission characteristics of a low transmission loss were obtained and the power ratio after branch can be adjusted by setting the positional relationships of the center lines and disposition of the through conductors 43 for adjusting the power ratio.

As described above, it was confirmed that, according to the branch structure of a dielectric waveguide line of the invention a line can be formed in a dielectric substrate, a high-frequency signal does not radiate or leak an electromagnetic wave, one line can be branched into three lines, the power ratio after branch can be arbitrarily set, and excellent transmission characteristics of a small transmission loss can be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A branch structure of a dielectric waveguide line comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width d in a direction perpendicular to the transmission direction, first and second dielectric waveguide lines which transmit the high-frequency signal through a region surrounded by the conductor layers and the through conductor groups being disposed, a tip end of the first dielectric waveguide line being perpendicularly connected to an opening disposed in one side of the second dielectric waveguide line, wherein the through conductor groups in another side opposed to the opening of the second dielectric waveguide line are formed along two arcs which are respectively centered at through conductors at ends of the opening and which have a radius equal to the constant width d, to have a vertex at an intersection of the two arcs.

2. A branch structure of a dielectric waveguide line comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width d in a direction perpendicular to the transmission direction, first and second dielectric waveguide lines which transmit the high-frequency signal through a region surrounded by the conductor layers and the through conductor groups being disposed, a tip end of the first dielectric waveguide line being perpendicularly connected to an opening disposed in one side of the second dielectric waveguide line, wherein the through conductor groups in another side opposed to the opening of the second dielectric waveguide line are formed along oblique sides of a triangle which has a base equal to the width of the opening, a vertex on a center line of the first dielectric waveguide line, and a height of d/2 or less.

3. A branch structure of a dielectric waveguide line comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width d in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line with setting transmission directions of the lines to be perpendicular to each other, wherein a width w of the opening satisfies relationships of $d<w\leqq 2d$ with respect to the constant width d, the tip end of the first dielectric waveguide line is connected to the opening by connection through conductor groups in which through conductors are arranged along arcs, and the through conductor groups in another side opposed to the opening of the second dielectric waveguide line is formed along two arcs which are respectively concentric with the arcs and which have a radius equal to a sum r+d of a radius r of the arcs and the constant width d, to have a vertex at an intersection of the two arcs.

4. A branch structure of a dielectric waveguide line comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width d in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line so that transmission directions of the lines are perpendicular to each other, wherein a width w of the opening satisfies relationships of $d<w\leqq 5d$ with respect to the constant width d, and the tip end of the first dielectric waveguide line is connected to the opening by connection through conductor groups linearly arranged.

5. A branch structure of a dielectric waveguide line comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width d in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line so that transmission directions of the lines are perpendicular to each other, wherein a width w of the opening satisfies relationships of $d<w\leqq 5d$ with respect to the constant width d, and the tip end of the first dielectric waveguide line is connected to the opening by connection through conductor groups arcuately arranged.

6. A branch structure of a dielectric waveguide line comprising: a pair of conductor layers between which a dielectric substrate is sandwiched; and two rows of through conductor groups which are formed to electrically connect the conductor layers to each other at repetition intervals not more than one half of a signal wavelength of a high-frequency signal in a transmission direction of the high-frequency signal, and at a constant width d in a direction perpendicular to the transmission direction, first and second dielectric waveguide lines which transmit the high-frequency signal through a region surrounded by the conductor layers and the through conductor groups being disposed, a tip end of the first dielectric waveguide line being connected to an opening disposed in one side of the second dielectric waveguide line so that transmission directions of the lines are perpendicular to each other, wherein a width w of the opening satisfies relationships of $d<w\leqq 5d$ with respect to the constant width d, and the tip end of the first dielectric waveguide line is connected to the opening by intermediate through conductor groups which have a width equal to the width of the opening and a length that is about one quarter of a guide wavelength of the high-frequency signal.

7. The branch structure of a dielectric waveguide line of any one of claims 4 to 6, wherein the through conductor groups in another side opposed to the opening of the second dielectric waveguide line are formed along two arcs which are respectively centered at through conductors at ends of the opening and which have a radius equal to the constant width d, to have a vertex at an intersection of the two arcs.

8. The branch structure of a dielectric waveguide line of any one of claims 4 to 6, wherein the through conductor groups in another side opposed to the opening of the second dielectric waveguide line are formed along oblique sides of a triangle which has a base equal to the width of the opening, a vertex on a center line of the first dielectric waveguide line, and a height of d/2 or less.

* * * * *